US010032339B2

(12) United States Patent
Mead et al.

(10) Patent No.: US 10,032,339 B2
(45) Date of Patent: Jul. 24, 2018

(54) METHOD AND SYSTEM INCLUDING ENHANCED SYMBOL UPGRADE FEATURE

(71) Applicant: IGT, Las Vegas, NV (US)

(72) Inventors: Dennis K. Mead, Carson City, NV (US); Ryan M. Griffin, Reno, NV (US); Dylan B. Selegue, Reno, NV (US)

(73) Assignee: IGT, Las Vegas, NV (US)

( * ) Notice: Subject to any disclaimer, the term of this patent is extended or adjusted under 35 U.S.C. 154(b) by 1084 days.

(21) Appl. No.: 14/298,276

(22) Filed: Jun. 6, 2014

(65) Prior Publication Data

US 2015/0356813 A1 Dec. 10, 2015

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
CPC ..... G07F 17/3213; G07F 17/34
See application file for complete search history.

(56) References Cited

U.S. PATENT DOCUMENTS 6,270,412 B1 8/2001 Crawford et al.
7,993,196 B2 * 8/2011 Pacey ..... G07F 17/32 273/138.1
2008/0051174 A1 * 2/2008 Fiden ..... G07F 17/34 463/20
2009/0124325 A1 * 5/2009 Wadleigh ..... G07F 17/34 463/20
2011/0105218 A1 * 5/2011 Anderson ..... G07F 17/32 463/20
2012/0190428 A1 * 7/2012 Wadleigh ..... G07F 17/34 463/20
2014/0228091 A1 * 8/2014 Berman ..... G07F 17/34 463/20
2014/0274284 A1 * 9/2014 Leupp ..... G07F 17/34 463/20
2014/0274294 A1 * 9/2014 Baerlocher ..... G07F 17/326 463/20
2014/0274295 A1 * 9/2014 Poole ..... G07F 17/326 463/20
2015/0080091 A1 * 3/2015 Saunders ..... G07F 17/326 463/20

* cited by examiner

*Primary Examiner* — Kang Hu
*Assistant Examiner* — Ahn Vo V Nguyen
(74) *Attorney, Agent, or Firm* — Griffiths & Seaton PLLC

(57) ABSTRACT

Methods, systems, and computer program products are provided that include an enhanced symbol upgrade feature. In an embodiment, if a triggering event occurs in association with the play of the game, such as a slot game, where the triggering event includes a first special symbol of the plurality of special symbols stopping on a payline at a first symbol position on a first reel of the first reel set, the first special symbol is superimposed at a symbol position on a second reel of the second reel set corresponding to the first symbol position on the first reel, and the second reel continues to rotate during the superimposition of the first special symbol thereover.

24 Claims, 16 Drawing Sheets

METHOD AND SYSTEM INCLUDING ENHANCED SYMBOL UPGRADE FEATURE

COPYRIGHT NOTICE

A portion of the disclosure of this patent document contains or may contain material, which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Field of the Invention

The present invention relates in general to gaming machines and systems, and more particularly to new and improved devices and systems having enhanced symbol upgrade features.

Description of the Related Art

Wager-based gaming is a multi-billion dollar industry with sustained popularity. Gaming entities, such as casinos, appeal to many different audiences and provide one or more of a variety of available different gaming machines. Mechanical and video reel gaming machines are a staple of the gaming industry. During play, a player places a wager, which then causes the gaming machine to rotate reels. Each reel independently rotates and stops to display symbols relative to one or more paylines to reveal predetermined winning or losing combinations of the symbols. If a winning symbol or winning combination of symbols is generated and displayed along a wagered-on payline, an award is provided to the player. If a winning symbol or combination of symbols is not generated and displayed along a wagered on payline, no award is provided to the player for that payline. After any awards are provided for any wagered-on payline or paylines, the play of the game ends.

To attract new players to games of chance and to enhance player enjoyment, gaming manufacturers continuously attempt to improve features of game play. In addition to augmenting the player's visual and audio experience, gaming machines include features that increase a player's chances for winnings or increase the amounts available to a player to be won. For example, some gaming machines feature multiple stacked reel sets (such as three or five reel sets), where each reel set operates as a separate game to provide optional simultaneous play of more than one game. Other gaming machines include different special symbols (e.g., bonus symbols, including by not limited to WILD, multipliers, such as 2× PAY, 3× PAY, 4× PAY, 5× PAY, and the like) that increase an outcome value or improve a chance of winning.

As gaming institutions have a continuing interest in encouraging greater participation by existing players and in enhancing the overall experience offered to existing and new customers alike, stiff competition exists among gaming manufacturers to deliver new and interesting games and gaming machines that entice players to engage in game play. Additionally, as increased game play typically translates to increased revenue, gaming manufacturers strive to design new features to increase player engagement with the gaming machine.

SUMMARY OF THE INVENTION

To address the need for game play that prolongs player engagement and entices new players to engage with the gaming machines, in accordance with an embodiment, by way of example only, a system is provided that has an enhanced symbol upgrade feature. The system, includes a housing, at least one display device supported by the housing, at least one input device supported by the housing, at least one processor, and at least one memory device which stores a plurality of instructions. When the instructions are executed by the at least one processor, they cause the at least one processor to operate with the at least one display device and the at least one input device to at least partially display a play of a game. The game includes rotating a plurality of reels having a plurality of symbols, the plurality of reels being part of a first reel set and a second reel set positioned over the first reel set, the plurality of reels of each of the first and second reel sets arranged adjacent each other, the plurality of symbols passing a payline during the rotation of each reel, the plurality of symbols including a plurality of special symbols, and each reel including a plurality of symbol positions associated therewith. The game also includes stopping the rotation of each reel to display one of the plurality of symbols of the reel relative to the payline, and awarding an award, in response to an identification of a predetermined winning combination of symbols being displayed on the payline. The instructions also cause the at least one processor to operate with the at least one display device and the at least one input device to, if a triggering event occurs in association with the play of the game, the triggering event including a first special symbol of the plurality of special symbols stopping on the payline at a first symbol position on a first reel of the first reel set, superimpose the first special symbol at a symbol position on a second reel of the second reel set corresponding to the first symbol position on the first reel, and continue to rotate the second reel during the superimposition of the first special symbol thereover.

Other systems, methods, and computer program product embodiments are provided and supply related advantages.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
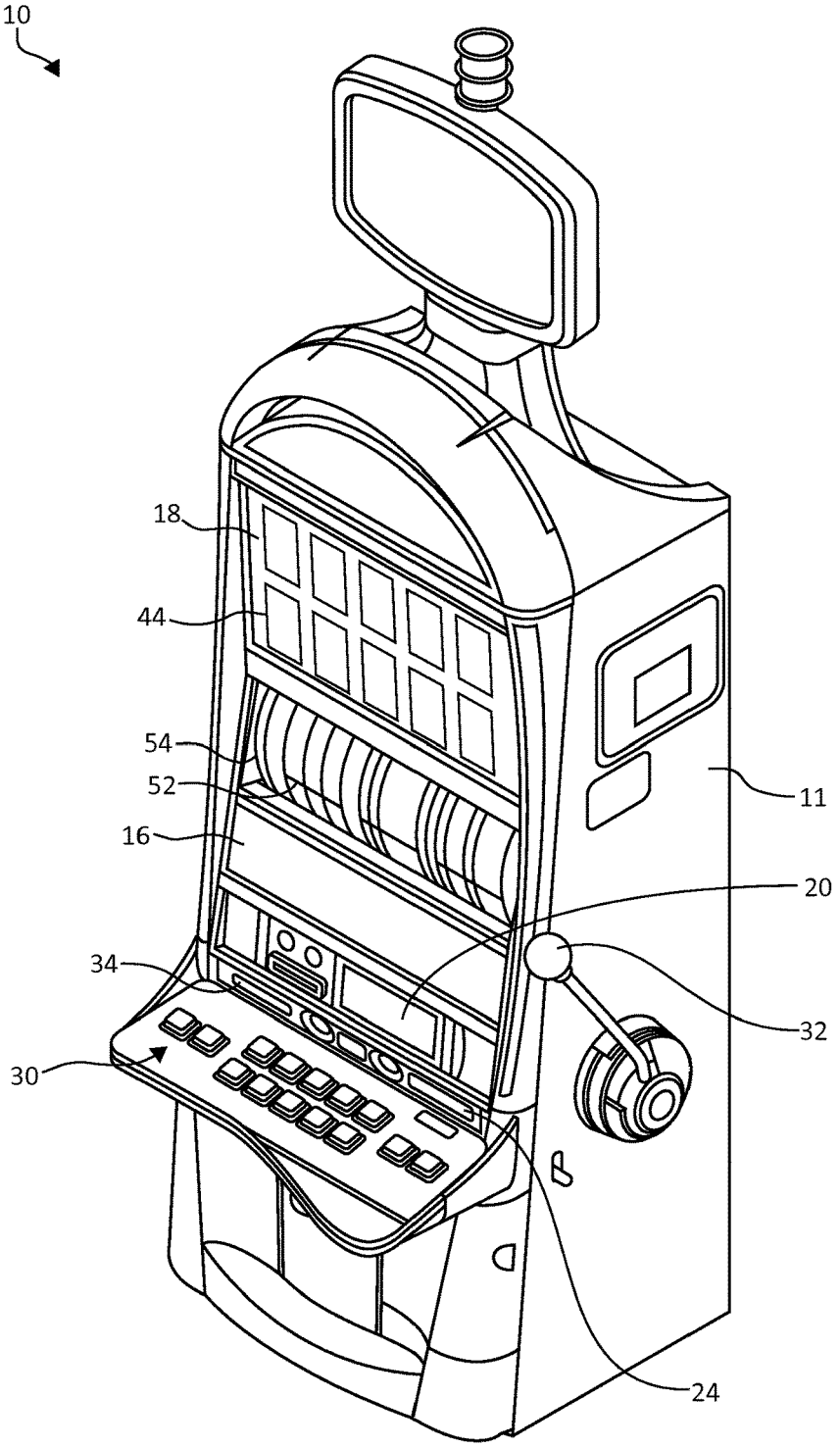
FIG. 1 illustrates a perspective view of one embodiment of a gaming machine, in which aspects of the present invention may be realized.

In general, gaming machines require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar, or for virtual currency, one point, one coin, one credit, or one virtual buck) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming machine, such as a slot game, may allow players to make wagers of substantially different amounts on each play of the primary or base game ranging, for example, from one credit up to 125 credits (e.g., five credits on each of 25 separate pay lines).

Secondary or bonus games may also be provided in the gaming machines. The secondary or bonus games may provide an additional award to the player and may be activated or triggered upon an occurrence of a designated triggering symbol or triggering symbol combination in the primary or base game. For instance, a bonus symbol occurring on the pay line on the third reel of a three-reel slot machine may trigger the secondary bonus game. When a secondary or bonus game is triggered, the gaming machines may indicate this to the player through one or more visual and/or audio output devices, such as the reels, lights, display units, speakers, video screens, etc. Part of the enjoyment and excitement of playing certain gaming machines is the occurrence of the secondary or bonus game (even before the player knows how much the bonus award will be). In other words, obtaining a bonus play experience is part of the enjoyment and excitement for players.

To further enhance the excitement surrounding the base play and bonus play experience, improved gaming machines are now provided that propagate special symbols, such as bonus symbols, from one reel of a reel set to another to increase a player's chances of winning. In an example in which a gaming machine includes three stacked reel sets and each reel set has a plurality of reels, all of the reels are initially set in motion during game play. After a period of time, a bottommost reel set resolves from left to right, next the middle reel set resolves from left to right, and finally the topmost reel set resolves from left to right. If a special symbol appears during the resolution of one of the bottommost reel set and the middle reel set, the special symbol propagates directly upward from the bottommost reel set to both the middle and topmost reel sets or directly upward from the middle reel set to the topmost reel set to form a column of the special symbols superimposed over the still-spinning reels. After all of the reels stop spinning, the superimposed special symbol, which obscures any symbol at which the reels stop, replaces the obscured symbol. If after the resolution of the middle reel set, the reel stops at another special symbol having a higher value than the superimposing symbol, the higher value special symbol replaces the superimposing symbol and propagates downward to thereby replace the special symbol in the same column on the bottommost reel set.

Referring now to the drawings, an embodiment of a gaming machine 10 in which the present invention is implemented is illustrated FIG. 1. The gaming machine 10 has a support structure, a housing or a cabinet 11, which supports a plurality of displays, inputs, controls and other features of a conventional gaming machine such that a player can operate the gaming machine 10 while standing or sitting. The gaming machine 10 may be positioned on a base or stand or can be a pub-style tabletop game (not shown), which a player can operate preferably while sitting.

Figure 2A:
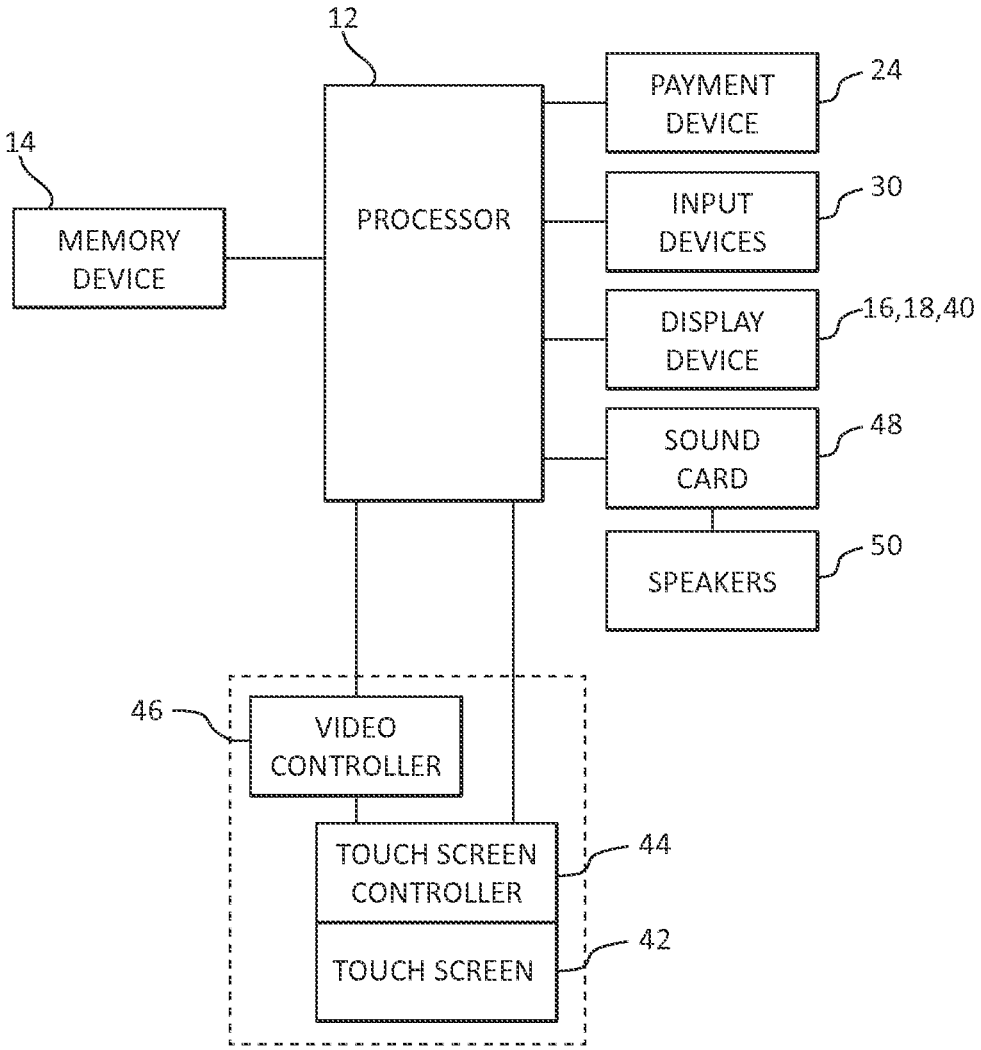
FIG. 2A is a block diagram illustrating an electronic configuration for use in the gaming machine of FIG. 1, in which aspects of the present invention may be realized.

In one embodiment, as illustrated in FIG. 2A, the gaming machine 10 preferably includes at least one the processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming machine. The memory device stores program code and instructions, executable by the processor, to control the gaming machine. The memory device also stores other data such as image data, event data, player input data, random or pseudo-random number generators, pay-table data or other operating data, information and applicable game rules that relate to the play of the gaming machine. In another embodiment, the memory device includes random access memory (RAM). In one embodiment, the memory device includes read only memory (ROM). In a further embodiment, the memory device includes flash memory and/or EEPROM (electrically erasable programmable read only memory). Any other suitable magnetic, optical and/or semiconductor memory may be implemented in conjunction with the gaming machine of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, the gaming machine 10 randomly generates awards and/or other game outcomes based on probability data. That is, each award or other game outcome is associated with a probability and the gaming machine generates the award or other game outcome to be provided to the player based on the associated probabilities. In this embodiment, since the gaming machine generates outcomes randomly or based upon a probability calculation, there is no certainty that the gaming machine will provide the player with any specific award or other game outcome.

In another embodiment, the gaming machine 10 employs a predetermined or finite set or pool of awards or other game outcomes. In this embodiment, as each award or other game outcome is provided to the player, the gaming machine removes the provided award or other game outcome from the predetermined set or pool. Once removed from the set or pool, the specific provided award or other game outcome cannot be provided to the player again. In this type of embodiment, the gaming machine provides players with all of the available awards or other game outcomes over the course of the play cycle and guarantees a designated amount of actual wins and losses.

With continued reference to FIGS. 1 and 2A, the gaming machine 10 includes one or more display devices 16, 18, 20 disposed in a display area. The display devices 16, 18, 20 are controlled by a processor 12. The display devices 16, 18, 20 are preferably connected to or mounted to the cabinet of the gaming machine. The display area includes a secondary display device 16 and a primary display device 18. The secondary display device 16 may display any suitable secondary game associated with the primary game as well as information relating to the primary or secondary game. The primary display device 18 may display the primary game, any suitable secondary game associated with the primary game and/or information relating to the primary or secondary game. The gaming machine 10 includes a player tracking unit display 20 which displays a player's current number of credits, cash, account balance or the equivalent and a player's amount wagered.

The display devices 16, 18, 20 may include, without limitation, a monitor, a television display, a plasma display, a multi-layer display (MLD), a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices 16, 18, 20 of the gaming machine 10 display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In an embodiment, the symbols, images and indicia displayed on or of the display devices 16, 18, 20 may be in mechanical form. That is, the display devices 16, 18, 20 may include any electromechanical device, such as one or more mechanical objects, such as one or more rotatable wheels, reels, or dice, configured to display at least one or a plurality of game or other suitable images, symbols or indicia.

The gaming machine 10 includes at least one payment device in communication with the processor 12. As seen in FIG. 1, the payment device such as a payment acceptor includes a note, ticket or bill acceptor 24 wherein the player inserts paper money, a ticket, or voucher and a coin slot where the player inserts money, coins, or tokens. In other embodiments, payment devices such as readers or validators for credit cards, debit cards or credit slips may accept payment. In an embodiment, a player may insert an identification card into a card reader of the gaming machine. The identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming machine. For example, money may be transferred to a gaming machine through electronic funds transfer. When a player funds the gaming machine 10, the processor 12 determines the amount of funds entered and displays the corresponding amount on the credit or other suitable display as described above.

The gaming machine 10 further includes at least one and preferably a plurality of input devices 30 in communication with the processor 12. The input devices 30 can include any suitable device, which enables the player to produce an input signal, which is received by the processor. In one embodiment, after appropriate funding of the gaming machine, the input device is a game activation device, such as a play button or a pull arm 32, which is used by the player to start any primary game or sequence of events in the gaming machine. The play button can be any suitable play activator such as a bet one button, a max bet button, or a repeat the bet button. In one embodiment, upon appropriate funding, the gaming machine begins the game play automatically. In another embodiment, upon the player engaging one of the play buttons, the gaming machine automatically activates game play.

According to an embodiment, one input device 30 is a bet one button. The player places a bet by pushing the bet one button and can increase the bet by one credit each time the player pushes the bet one button. In response to receiving input associated with the player pushing the bet one button, the number of credits shown in the credit display preferably decreases by one, and the number of credits shown in the bet display preferably increases by one. In another embodiment, one input device 30 is a bet max button (not shown), which enables the player to bet the maximum wager permitted for a game of the gaming machine.

Additionally or alternatively, one input device 30 is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming machine disclosed herein.

As noted briefly above, the gaming machine 10 includes a touch-screen 42 coupled with a touch-screen controller 44 or some other touch-sensitive display overlay for player interaction with the images on the display. The touch-screen 42 and touch-screen controller 44 are connected to a video controller 46, which allows a player to make decisions and input signals into the gaming machine by touching the touch-screen 42 at the appropriate locations. One such input device is a conventional touch-screen button panel.

The gaming machine 10 may further include a plurality of communication ports 47 for enabling communication of the processor with external peripherals, such as external video sources, expansion buses, game or other displays, a SCSI port, or a keypad.

With continued reference to FIGS. 1 and 2A, the gaming machine 10 includes a sound-generating device controlled by one or more sounds cards 48, which function in conjunction with the processor. In accordance with an embodiment, the sound generating device includes at least one and preferably a plurality of speakers 50 or other sound generating hardware and/or software for generating sounds, such as by playing music for the primary and/or secondary game or by playing music for other modes of the gaming machine, such as an attract mode. In one embodiment, the gaming machine supplies dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized to provide any appropriate information.

The gaming machine 10 further includes a sensor, such as a camera, in communication with the processor 12 (and possibly controlled by the processor), that is selectively positioned to acquire an image of a player actively using the gaming machine and/or the surrounding area of the gaming machine. In an embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

The gaming machine 10 can incorporate any suitable wagering game as the primary or base game. The gaming machine or device 10 may include some or all of the features of conventional gaming machines or devices. The primary or base game may comprise any suitable reel-type game, such as slots, or other games of chance susceptible to representation in an electronic or electromechanical form, which in one embodiment produces a random outcome based on probability data at the time of or after placement of a wager.

In one embodiment, as illustrated in FIG. 1, a base or primary game is a slot game with one or more paylines 52. In an example, the gaming machine 10 includes at least one and preferably a plurality of reels 44 and 54, such as three to five reels 44, 54, displayed in video form on, for example, the display device 18, with simulated reels 44 and movement thereof and/or in electromechanical form with mechanical rotating reels 54 arranged as a plurality of adjacent, rotatable reels. The simulated reels 44 are disposed in reel sets and positioned over the reel set including mechanical rotating reels 54. The mechanical rotating reels 54 are combined and operably coupled with the simulated reels 44 of the display device 18. Each reel 44, 54 displays a plurality of indicia or symbols, such as bells, hearts, fruits, numbers, letters, bars, or other images which preferably correspond to a theme associated with the gaming machine. The symbols also include special symbols, such as multiplier symbols (e.g., 2× Pay, 3× Pay, 4× Pay, 5× Pay, where 3× Pay has a higher value than 2× Pay, 4× Pay has a higher value than 3× Pay and so on) or WILD symbols, which may or may not be valued higher than the multiplier symbols. Other special symbols having higher or lower values than those previously listed are included in another embodiment.

As noted above, each reel 44, 54 eventually stops so that one or more of the symbols lands on, one or more paylines. The paylines may be horizontal, vertical, circular, diagonal, angled or any combination thereof. In another embodiment, one or more of the paylines each include a plurality of adjacent symbol display positions on a requisite number of adjacent reels. In one such embodiment, one or more paylines are formed between at least two symbol display positions which are adjacent to each other by either sharing a common side or sharing a common corner (i.e., such paylines are connected paylines). In these embodiments, the gaming machine enables a player to wager on one or more of such paylines to activate such wagered on paylines.

In another embodiment in which one or more paylines are formed between at least two symbol display positions, which are adjacent to each other, the gaming machine enables a player to wager on and thus activate a plurality of symbol display positions. In this embodiment, one or more paylines which are formed from a plurality of adjacent active symbol display positions on a requisite number of adjacent reels are activated.

Several features are included to enhance player experience, for example, by building anticipation for a player during the period between the initiation of reel spin and just prior to the display of an outcome of symbol combinations on the one or more paylines. Specifically, the gaming machine 10 displays a play of a game where different trigger events cause special symbols to propagate from one reel in one reel set to another reel in another reel set. The various embodiments of the events that trigger an enhanced symbol upgrade feature are described in conjunction with FIGS. 3A-5E below.

Figure 3A:
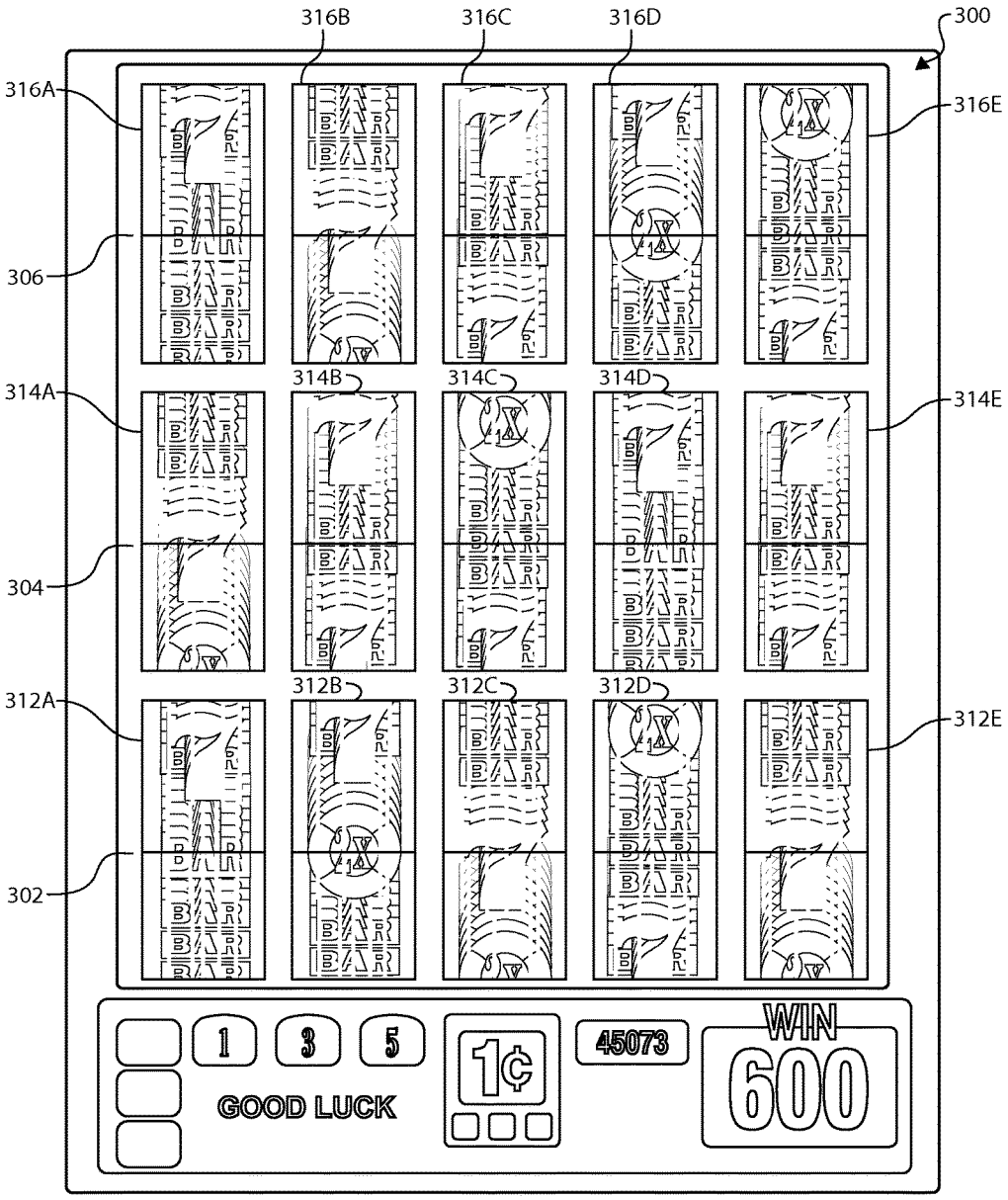
FIGS. 3A-3D illustrate a display area of the gaming machine of FIG. 1 depicting an embodiment of a game play during which events occur to trigger an enhanced symbol upgrade feature, in which aspects of the present invention may be realized.

FIGS. 3A-3D is a display area 300 of a gaming machine illustrating a first trigger event scenario, in accordance with an embodiment. The display area 300 includes three stacked reel sets (bottom, middle, and top reel sets) 302, 304, 306. Each reel set includes a plurality of reels 312*a-e*, 314*a-e*, 316*a-e*, which as mentioned above, can include mechanical reels, video reels, or a combination of both. For example, a bottom reel set 302 includes mechanical reels, while middle and top reel sets 304, 306 include video reels. In any case, reels 312*a-e*, are disposed adjacent each other, reels 314*a-e* are disposed adjacent each other, and so on. It will be understood that reel sets 302, 304, 306 are positioned such that reels 312*a*, 314*a*, and 316*a* are aligned to form a column, 312*b*, 314*b*, and 316 are aligned to form a column, and so on. A player supplies an input to the gaming machine to initiate game play (e.g., by the press of the bet one button, the bet max button, or the repeat bet button), and in response, all three reel sets 302, 304, 306 are set in motion, a screen shot of which is shown in FIG. 3A.

Generally, the first trigger event is initiated when reels in either bottom or middle reel sets reveal a special symbol. In particular, in an embodiment in which a reel in the bottom reel set reveals a special symbol, the same special symbol is propagated upwardly along the column in which the reel is positioned to the topmost reel set and the special symbol superimposes a corresponding symbol on reels of the middle and topmost reel sets. The reels of the middle and topmost reels sets continue to spin until resolution of each occurs.

Figure 3B:
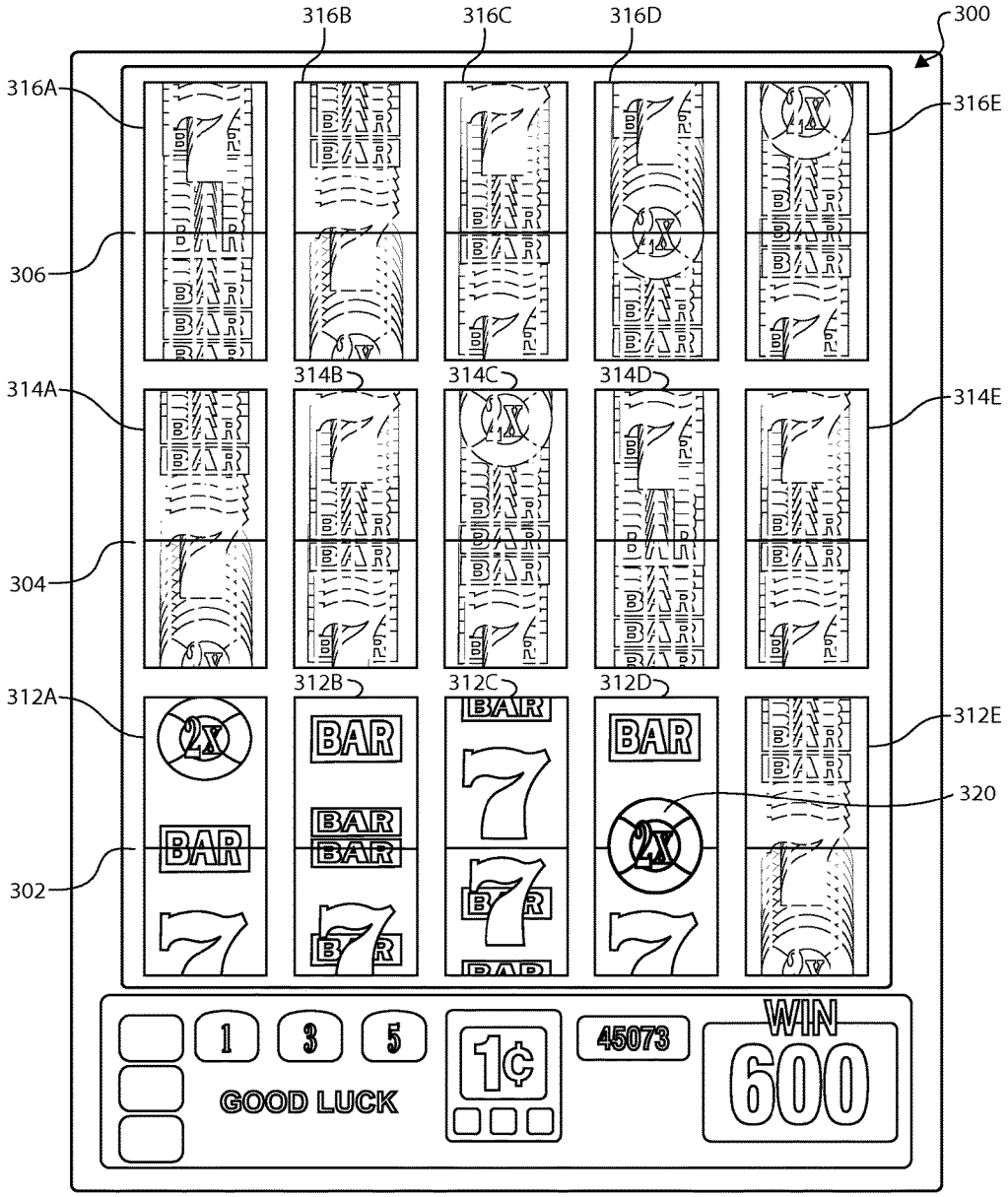
Figure 3C:
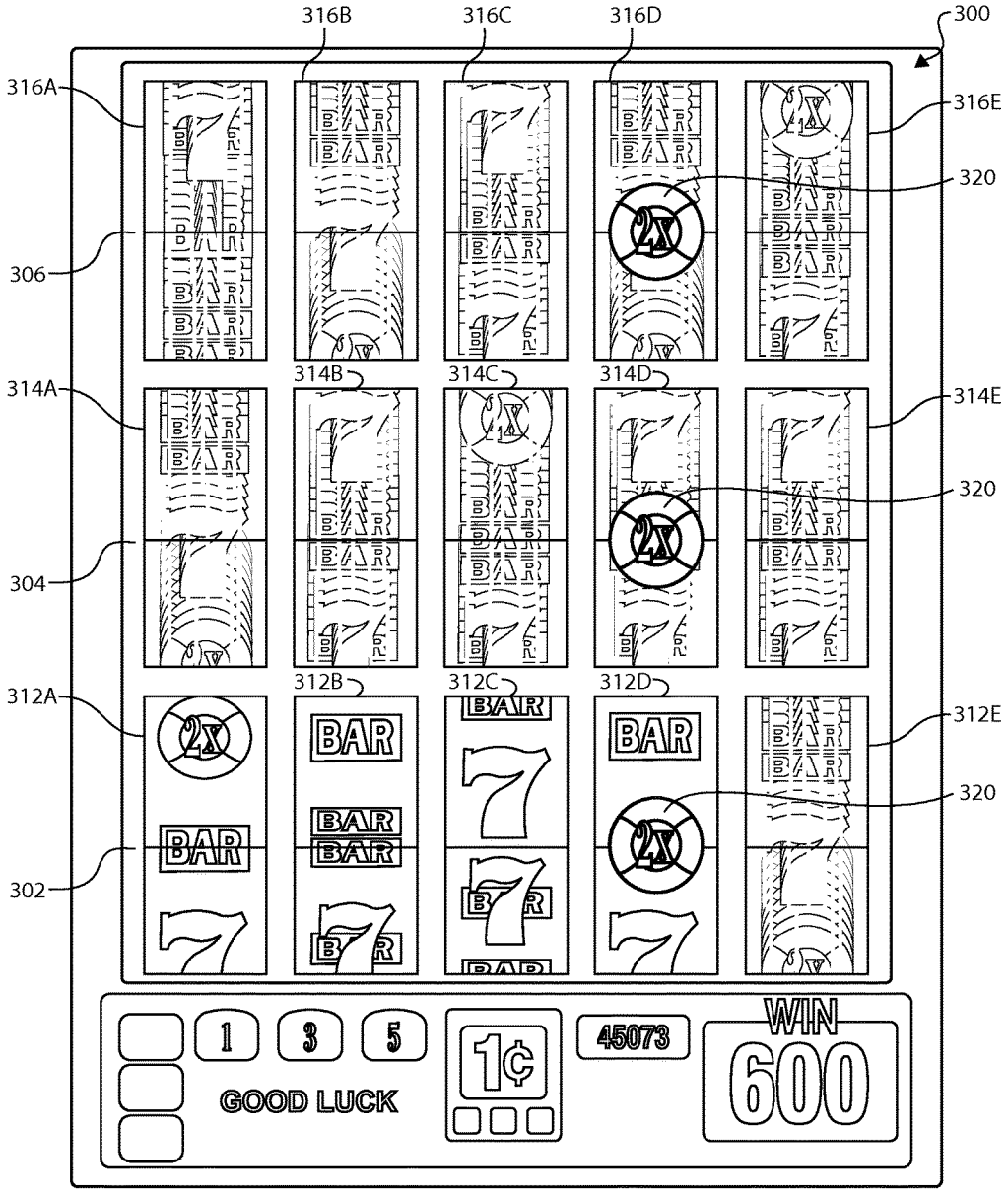
Figure 3D:
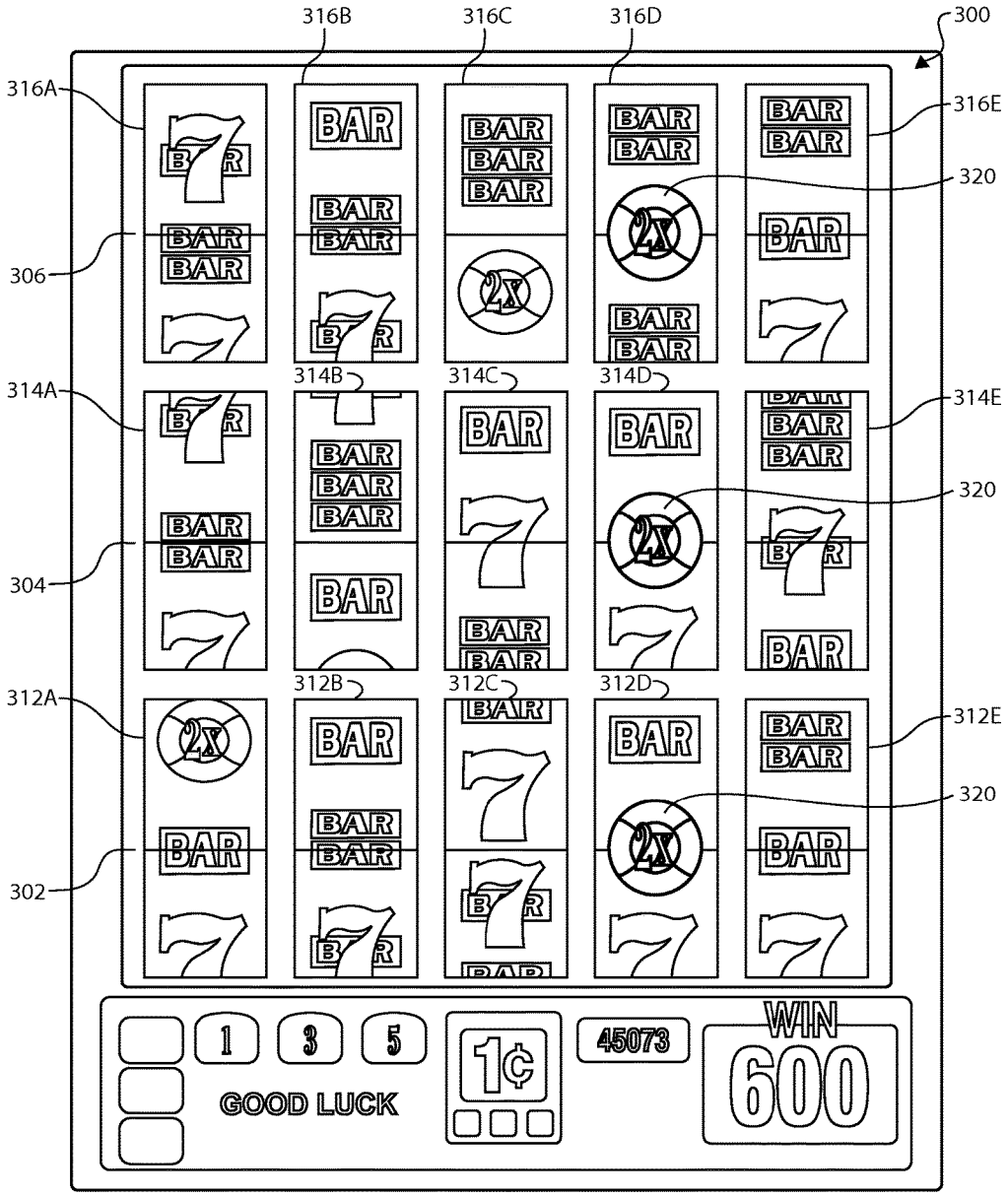

In an example, turning to FIG. 3B, after a brief period, bottom reel set 302 resolves from left to right such that reel 312*a* stops, followed by reel 312*b*, and reel 312*c* and so on. As a result of the resolution of reel 312*d*, a special symbol (here, a 2× Multiplier special symbol 320) is displayed. To inject added excitement into the game play, 2× Multiplier special symbol 320 propagates upward to reel 314*d* and 316*d* of middle reel set 304 and top reel set 306, respectively, as middle and top reel sets 304, 306 continue to spin, as illustrated in FIG. 3C. 2× Multiplier special symbol 320 appears over middle and top reel sets 304, 306 substantially simultaneously after initially appearing on bottom reel set 302, in an embodiment. Alternatively, 2× Multiplier special symbol 320 can appear to cascade upward, thus appearing initially on bottom reel set 302, followed by middle reel set 304, and then on top reel set 306. According to an embodiment, the display of 2× Multiplier special symbol 320 is superimposed over the reels 304, 306, while spinning reels 304, 306 are visible behind 2× Multiplier special symbol 320. At the end of game play, middle and top reel sets 304, 306 stop spinning and 2× Multiplier special symbols 320, which are superimposed over and obscure portions of middle and top reel sets 304, 306, replace any symbol on middle and top reel sets 304, 306 that are obscured, as illustrated in FIG. 3D. It will be appreciated that in this embodiment, reels 314*d* and 316*d* stop at any random symbol, having a value lower than or identical to 2× Multiplier special symbol 320. In an embodiment, the obscured symbols disappear and are replaced by superimposing 2× Multiplier special symbols 320. In another embodiment, the obscured symbols blend together with 2× Multiplier special symbols 320 such that the superimposed 2× Multiplier special symbols 320 appear to have already been on reels 314*d*, 316*d*.

Figure 4A:
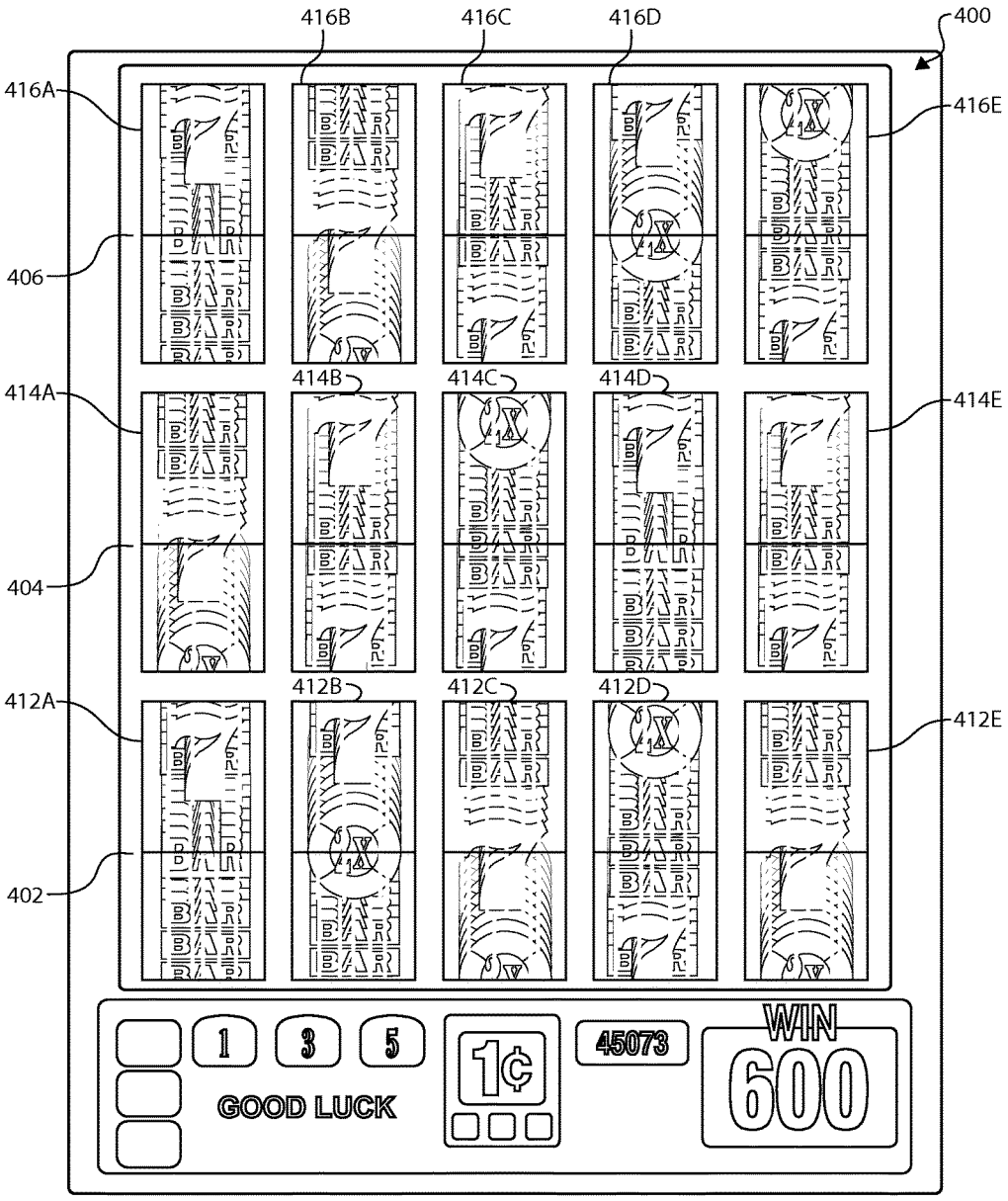
FIGS. 4A-4D illustrate a display area of the gaming machine of FIG. 1 depicting another embodiment of a game play during which events occur to trigger an enhanced symbol upgrade feature, in which aspects of the present invention may be realized.
Figure 4B:
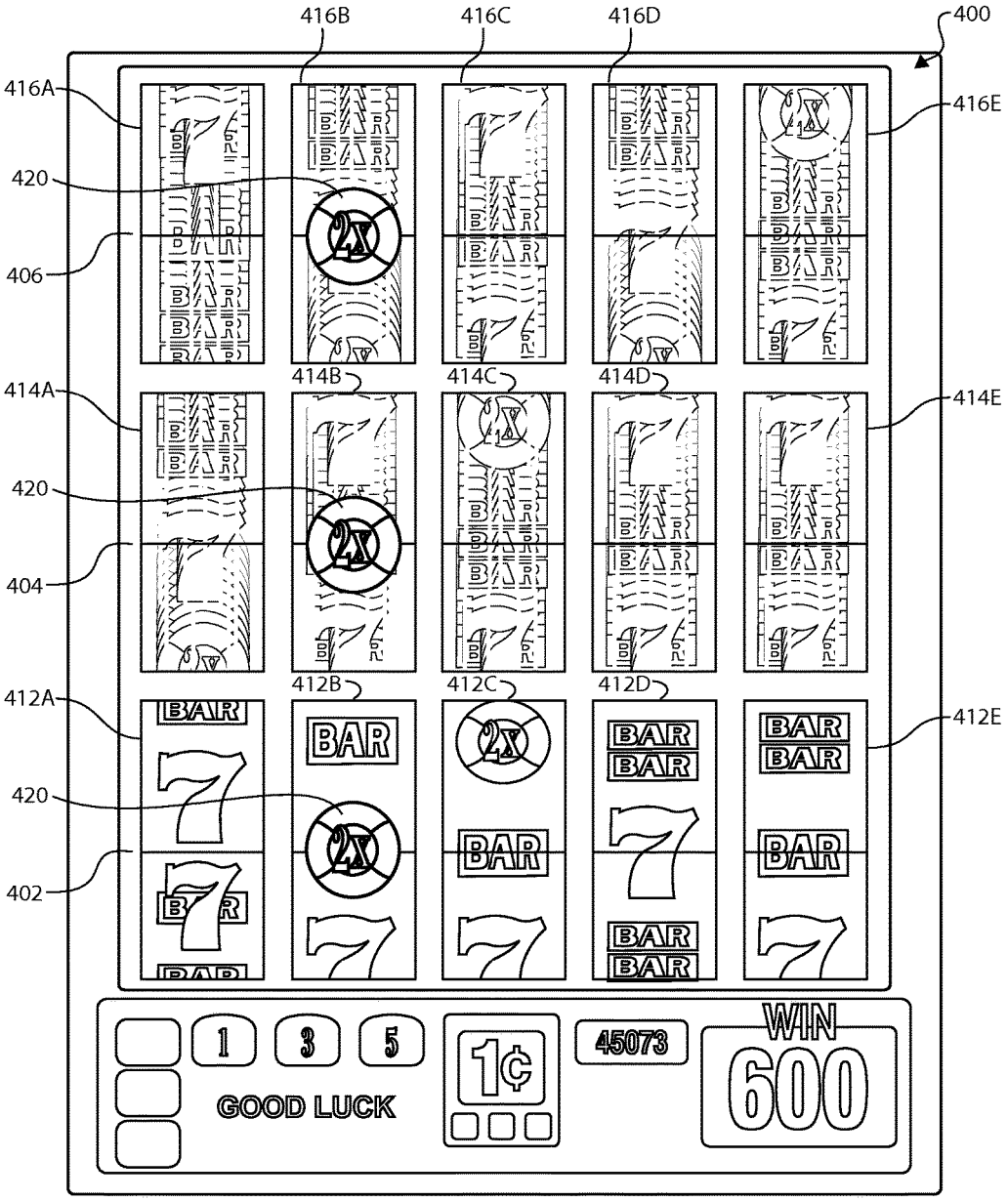
Figure 4C:
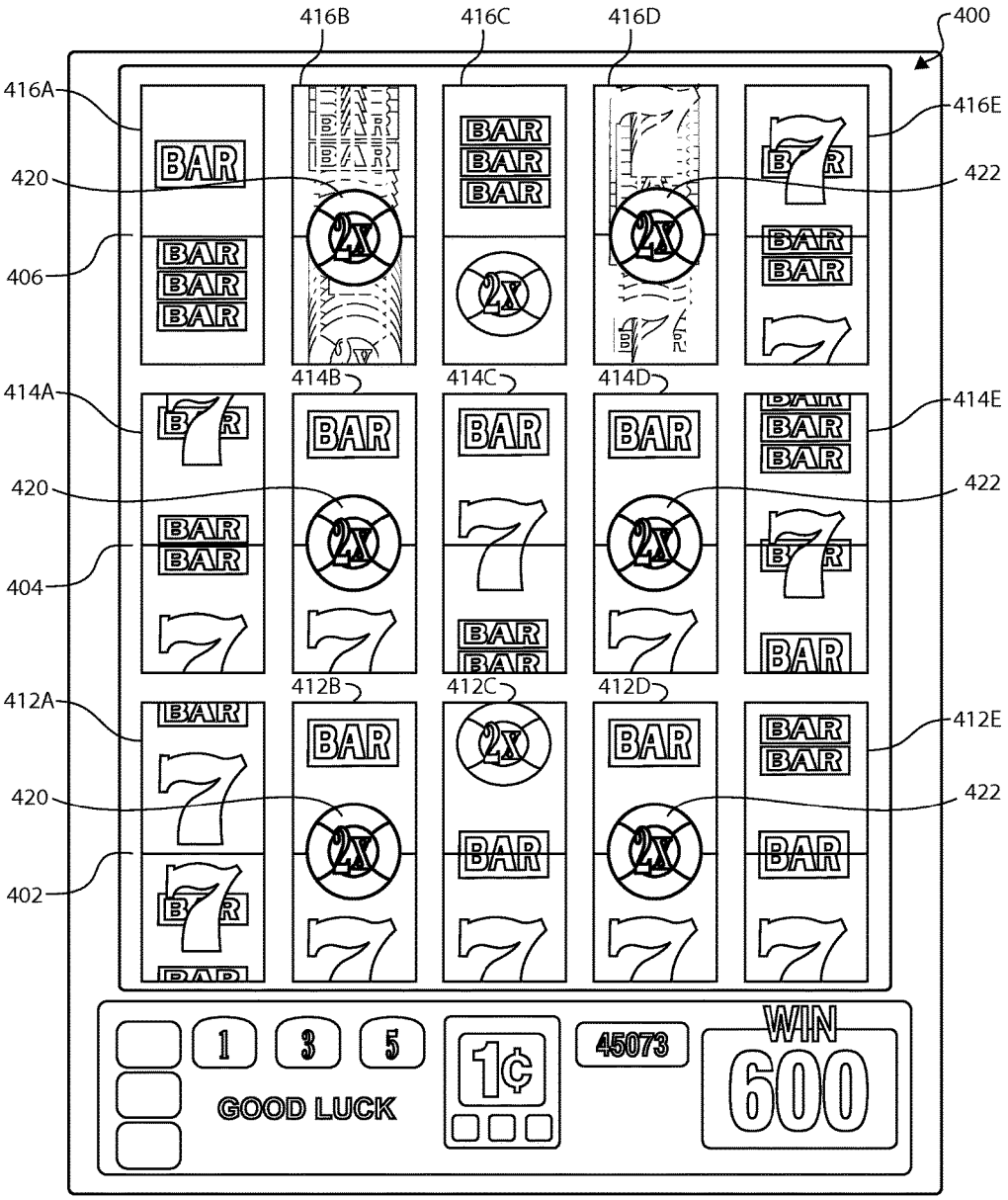
Figure 4D:
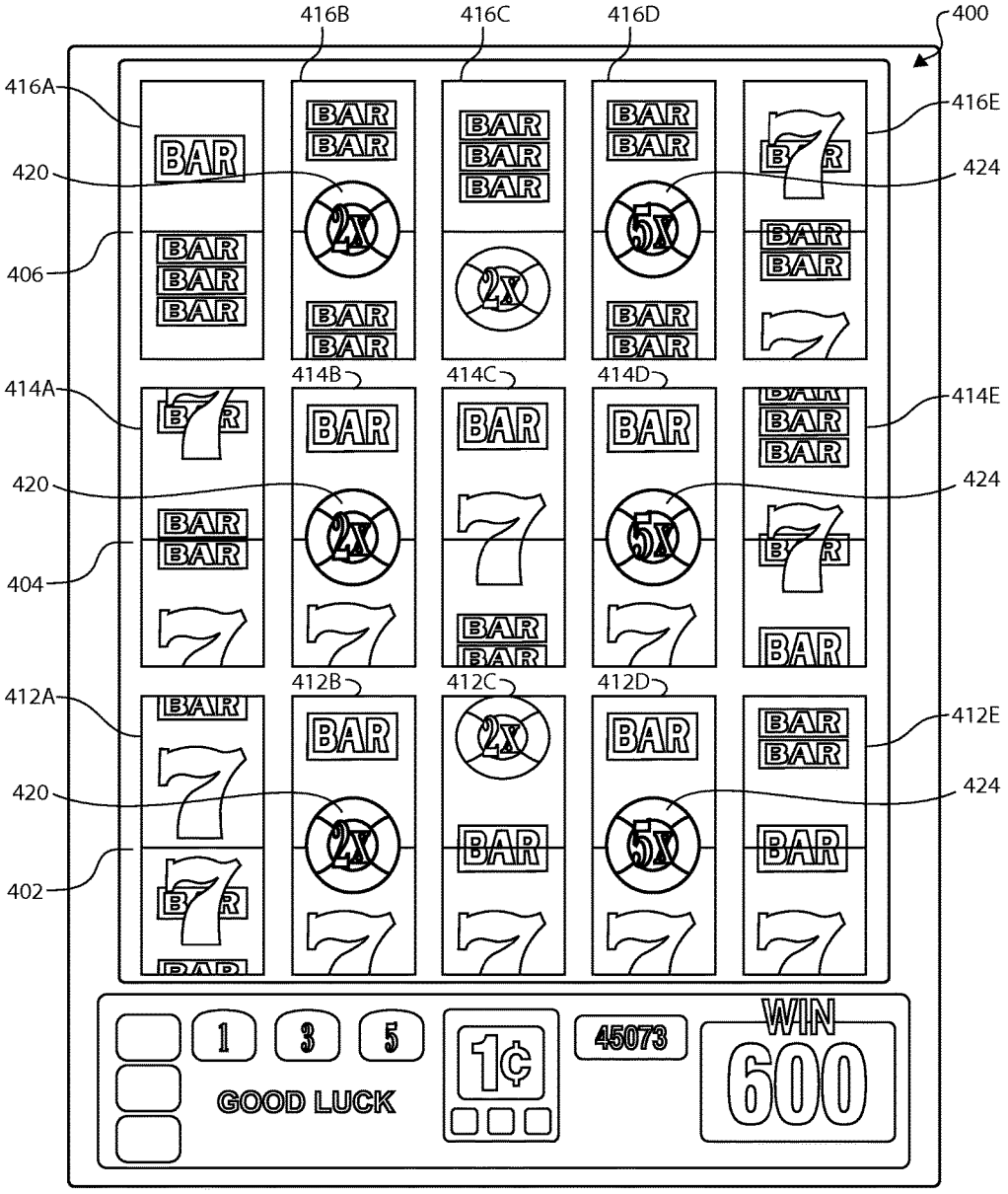

Similar to the embodiment described above, in an embodiment in which a reel in the middle reel set reveals a special symbol, the same special symbol is propagated upwardly along the column in which the reel is positioned to the topmost reel set. For example, FIGS. 4A-4D each illustrate a display area 400 of a gaming machine including three stacked reel sets (bottom, middle, and top reel sets) 402, 404, 406 and a plurality of reels 412*a-e*, 414*a-e*, 416*a-e* arranged substantially similar to reel sets 302, 304, 306 and reels 312*a-e*, 314*a-e*, 316*a-e* of FIGS. 3A-3D. A player supplies an input to the gaming machine to initiate game play (e.g., by the press of the bet one button, the bet max button, or the repeat bet button), and in response, all three reel sets 402, 404, 406 are set in motion, as illustrated in FIG. 4A. After a brief delay, bottom reel set 402 resolves from left to right such that reel 412*a* stops, followed by reel 412*b*, and reel 412*c* and so on, as illustrated in FIG. 4B. As a result of the resolution of reel 412*b*, a special symbol (here, a 2× Multiplier 420) is displayed. The same 2× Multiplier special symbol 420 propagates upward from reel 412*b* of bottom reel set 402 to reel 414*b* of middle reel set 404 to reel 416*b* of top reel set 406 with middle and top reel sets 404, 406 continuing to spin. Next, middle reel set 404 resolves from left to right, with 2× Multiplier special symbol 420 still superimposed over reel 414*b*. When reel 414*d* stops spinning, it lands on another special symbol (here, also a 2× Multiplier special symbol 422). 2× Multiplier special symbol 422 propagates upward from reel 414*d* in middle reel 404 to reel 416*d* in top reel set 406 with top reel set 406 still spinning. 2× Multiplier special symbol 422 is superimposed over top reel set 406 while top reel set 406 continues to spin, as illustrated in FIG. 4B. Although not illustrated, in another embodiment, 2× Multiplier special symbol 422 can also propagate downward from reel 414*d* in middle reel 404 to reel 412*d* in bottom reel set 402.

In a second type of trigger event, a special symbol having a high value replaces a superimposing special symbol having a lower value. More particularly, the second type of trigger event initiates when a spinning reel behind a superimposed low value special symbol stops at a higher value special symbol at the payline. The superimposed low value special symbol is then replaced with the higher value special symbol. For example, with reference to FIG. 4D, top reel set 406 resolves from left to right. 2× Multiplier special symbol 420 over reel 416*b* replaces the symbol on top reel set 406 over which it is displayed. In an embodiment, obscured symbol on top reel set 406 disappears and is replaced by 2× Multiplier special symbol 420, or obscured symbol morphs into special symbol 420. When reel 416*d* stops, another higher value special symbol (5× Multiplier special symbol 424) is displayed. Because 5× Multiplier special symbol 424 at reel 416*d* is a higher value special symbol than 2× Multiplier special symbol 422 previously stopped at resolved reel 412*d* and superimposing resolved reel 414*d*, the same 5× Multiplier special symbol 424 propagates downward. Thus, 5× Multiplier special symbol 424 of top reel set 406 replaces a previously superimposing 2× Multiplier special symbol 422 at reel 414*d* of middle reel set 404, and then replaces 2× Multiplier special symbol 422 showing on reel 412 of bottom reel set 402. In an embodiment, middle reel set 404 and bottom reel set 402, which were previously resolved, rotate slowly (at least slower than the initial spin) and/or backward to reveal 5× Multiplier special symbol 424. In an embodiment, the second type of trigger event can only be initiated by a reel in either the middle or top reel sets, because the initiating reel previously must have had a lower value special symbol superimposed upon it. In another embodiment, the second type of trigger event is initiated by a reel in the middle or top reel sets, but the initiating reel did not have a lower value special symbol superimposed upon it.

Figure 5A:
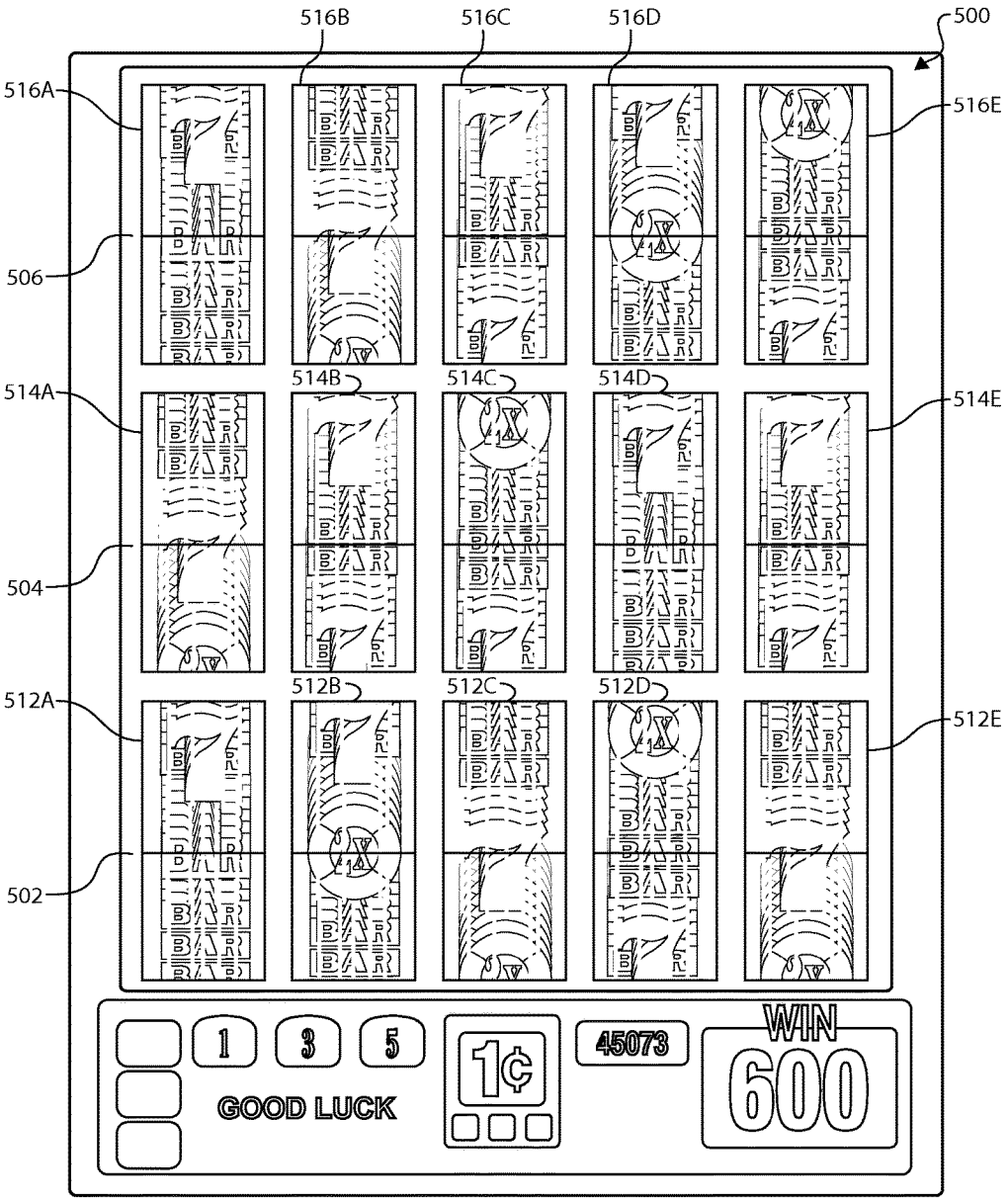
FIGS. 5A-5E is display area of the gaming machine of FIG. 1 depicting yet another embodiment of a game play during which events occur to trigger an enhanced symbol upgrade feature, in which aspects of the present invention may be realized.

FIGS. 5A-5E is display area 500 illustrating a single game play including a combination of the first and second types of trigger events, according to an embodiment. Here, the display area 500 includes three stacked reel sets (bottom, middle, and top reel sets) 502, 504, 506 and a plurality of reels 512*a-e*, 514*a-e*, 516*a-e* arranged substantially similar to reel sets 302, 304, 306 and reels 312*a-e*, 314*a-e*, 316*a-e* of FIGS. 3A-3D. A player supplies an input to the gaming machine to initiate game play (e.g., by the press of the bet one button, the bet max button, or the repeat bet button), and in response, all three reel sets 502, 504, 506 are set in motion, as illustrated in FIG. 5A. After a brief period, bottom reel set 502 resolves from left to right such that reel 512*a* stops, followed by reel 512*b*, and reel 512*c* and so on.

Figure 5B:
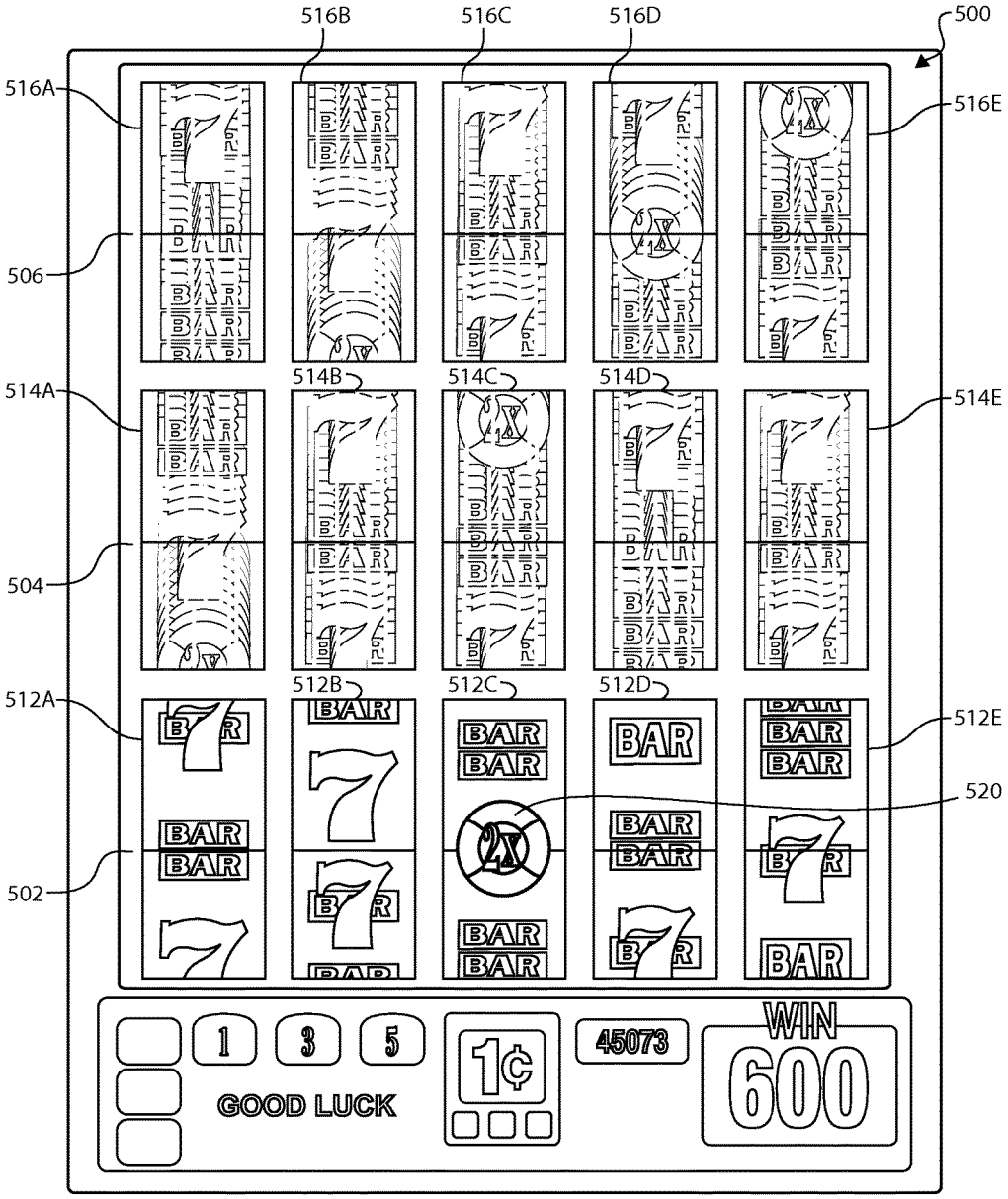
Figure 5C:
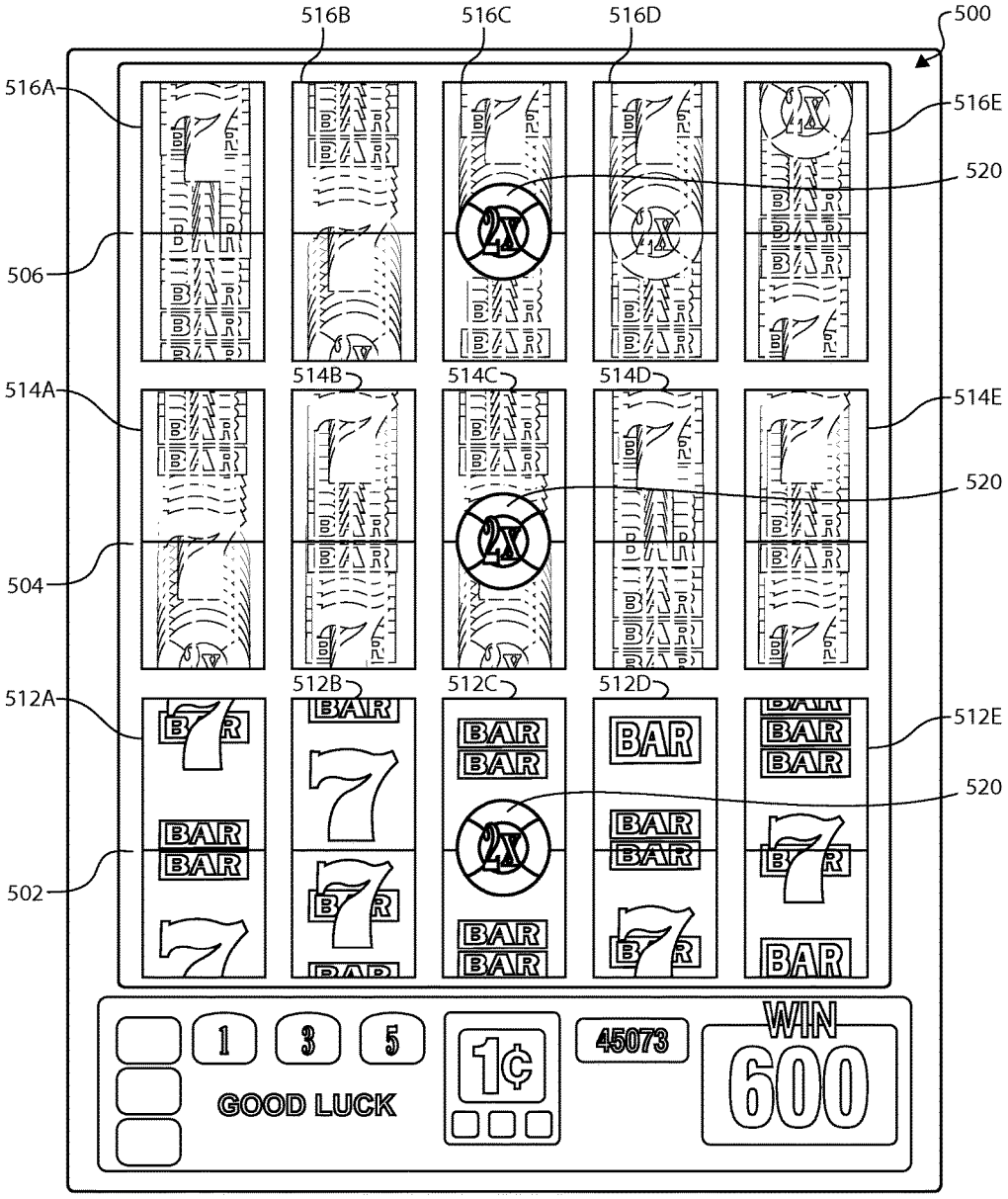
Figure 5D:
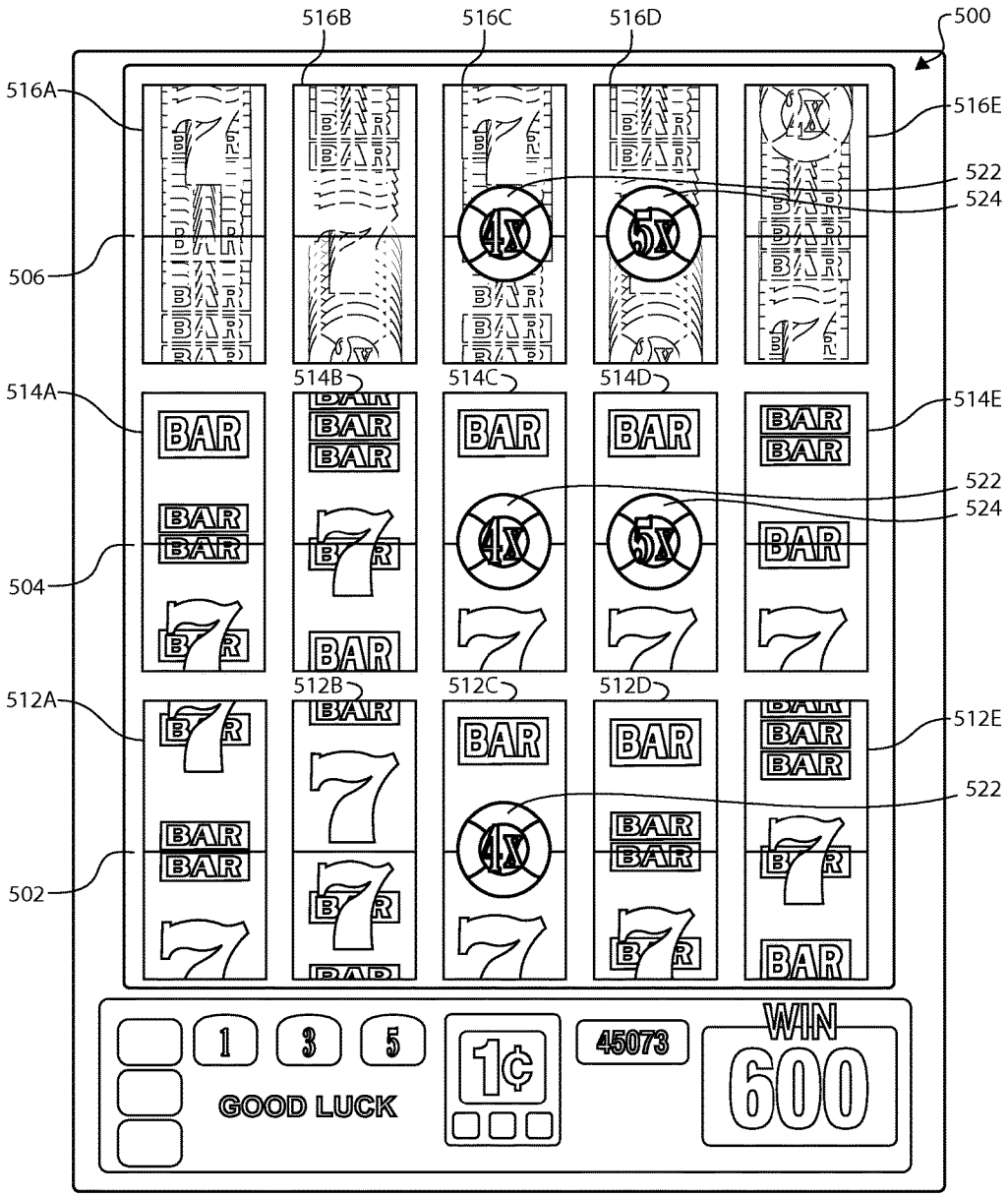

In an embodiment, bottom reel set 502 includes a special symbol. For example, reel 512*c* of bottom reel set 502 stops to display a 2× Multiplier special symbol 520 at the payline, as illustrated in FIG. 5B. Turning now to FIG. 5C, the same 2× Multiplier special symbol 520 propagates vertically upward from reel 512*c* to reel 514*c* of middle reel set 504, and then to reel 516*c* of top reel set 506 with middle reel set 504 and top reel set 506 continuing to spin in the background. As illustrated in FIG. 5D, middle reel set 504 resolves, and another special symbol (4× Multiplier special symbol 522) having a value that is higher than 2× Multiplier special symbol 520 is then displayed at reel 514*c*. Due to its higher value, 4× Multiplier special symbol 522 replaces the lower value 2× Multiplier special symbol 520 and also gets propagated upward to reel 516*c* in top reel set 506 to replace 2× Multiplier special symbol 520 superimposed over top reel set 406 while top reel set 506 continues to spin. In an embodiment, bottom reel set 502, which was previously resolved, rotates slowly (at least slower than the initial spin) and/or backward from 2× Multiplier special symbol 520 to reveal 4× Multiplier special symbol 522. Changing the speed at which a previously resolved reel rotates can be used to add a visually mesmerizing effect to build excitement for a player.

After or substantially concurrently with the replacement of the obscured symbol on middle reel set 504 with 2× Multiplier special symbol 520, reel 514*d* then stops spinning and displays another special symbol (e.g., a 5× Multiplier special symbol 524), which is propagated upward to reel 516*d* on top reel set 506 with top reel set 506 continuing to spin. In this embodiment, because bottom reel set 504 has already resolved and 5× Multiplier special symbol 524 appears in a reel position in which a corresponding reel on bottom reel set 524 did not include a previously propagated special symbol, 5× Multiplier special symbol 524 only propagates upward.

Figure 5E:
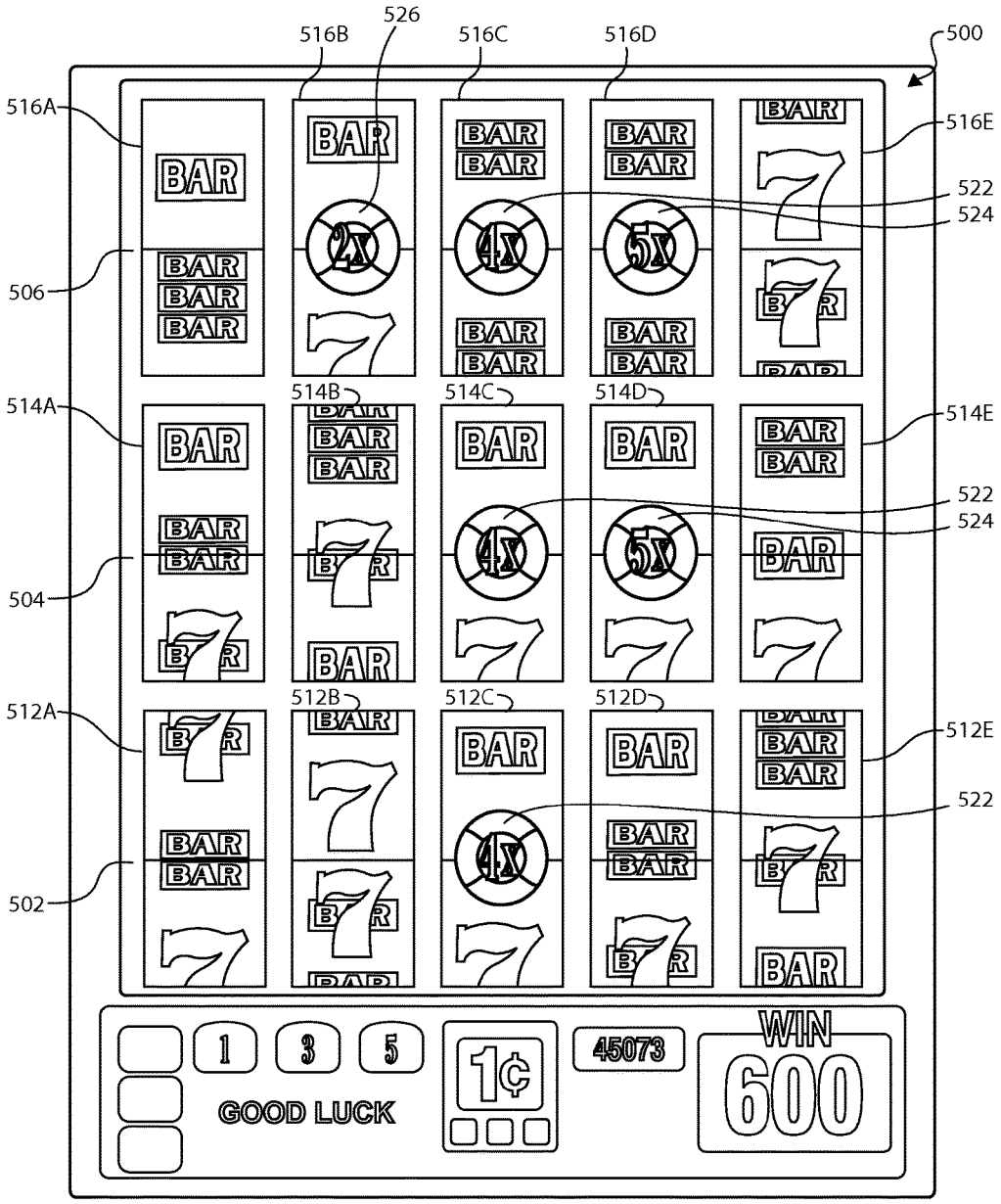

Top reel set 506 then resolves, as illustrated in FIG. 5E. In such case, reel 516*b* stops spinning to reveal a 2× Multiplier special symbol 526. Because special symbol 526 is initially revealed on top reel set 506 and corresponding reels on bottom and middle reel sets 502, 504 previously did not include superimposing/previously propagated symbols, special symbol 526 does not cascade downward and is only displayed on top reel set 506. Reel 516*c* ceases motion and 4× Multiplier special symbol 522, which superimposed reel 516*c*, replaces the lower value symbol on reel 516*c* that is under 4× Multiplier special symbol 522. Next, reel 516*d* stops spinning and 5× Multiplier special symbol 524, which previously superimposed reel 516*d* replaces the symbol thereon.

Although the embodiments illustrated above depict display areas including three reels sets with five reels each, it will be appreciated that fewer or more reel sets and/or reels are included in other embodiments. Additionally, in alternate embodiments, special symbols are revealed not only on the middle reels of the reel sets, but also on the outermost edge reels of the reel sets.

To further improve gaming pleasure for the player, several visual effects may be implemented to maximize player anticipation and build excitement. For example, one or more of the special symbols each may be associated with a corresponding special color, and thus, when a special symbol propagates upward or downward in a column from reel to reel, any white space previously showing in the column changes to the corresponding special color. In a particular example, 2× Multiplier is associated with a gold color and 3× Multiplier is associated with a green color. When a 2× Multiplier on a reel stops at a bottom reel set payline, the gold color is propagated either upward or downward along with the special symbol. If at a top reel set, a reel superimposed with the 2× Multiplier stops at a 3× Multiplier, the 2× Multiplier is replaced with the 3× Multiplier and as the 3× Multiplier propagates downward, the green color associated with the 3× Multiplier follows. It will be appreciated that other colors and color associations are implemented in other embodiments and each special symbol is associated with a different color to thereby create a synergistic viewing effect when adjacent reels have both resolved to their respective high value special symbol. In another example, lights (provided by LEDs mounted to the gaming machine 10) or sounds may accompany the occurrence of one of the trigger events.

According to another embodiment, the gaming machine 10 includes multi-layer displays to provide visual depth during gaming. In such case, the special symbols are displayed on a foreground display, while the spinning reel is displayed on a background display. In another embodiment, the gaming machine 10 includes a transmissive reel type display and a physical reel spins in a background, while a display screen disposed in front of the physical reel displays the special symbol.

Although anticipation for winning the game is increased due to the possibility for higher payouts, wins are not guaranteed and odds of winning are not changed. As with previous gaming machines, the gaming machine awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming machine determines any outcome to provide to the player based on the number of associated symbols which are generated in active symbol display positions on the requisite number of adjacent reels (i.e., not on paylines passing through any displayed winning symbol combinations). In this embodiment, if a winning symbol combination is generated on the reels, the gaming machine provides the player one award for that occurrence of the generated winning symbol combination. For example, if one winning symbol combination is generated on the reels, the gaming machine will provide a single award to the player for that winning symbol combination (i.e., not based on the number of paylines that would have passed through that winning symbol combination). It should be appreciated that because a gaming machine that enables wagering on ways to win provides the player one award for a single occurrence of a winning symbol combination and a gaming machine with paylines may provide the player more than one award for the same occurrence of a single winning symbol combination (i.e., if a plurality of paylines each pass through the same winning symbol combination), it is possible to provide a player at a ways to win gaming machine with more ways to win for an equivalent bet or wager on a traditional slot gaming machine with paylines.

In one embodiment, the total number of ways to win is determined by multiplying the number of symbols generated in active symbol display positions on a first reel by the number of symbols generated in active symbol display positions on a second reel by the number of symbols generated in active symbol display positions on a third reel and so on for each reel of the gaming machine with at least one symbol generated in an active symbol display position. For example, a three reel gaming machine with three symbols generated in active symbol display positions on each reel includes 27 ways to win (i.e., 3 symbols on the first reel ×3 symbols on the second reel ×3 symbols on the third reel). A four reel gaming machine with three symbols generated in active symbol display positions on each reel includes 81 ways to win (i.e., 3 symbols on the first reel ×3 symbols on the second reel ×3 symbols on the third reel ×3 symbols on the fourth reel). A five reel gaming machine with three symbols generated in active symbol display positions on each reel includes 243 ways to win (i.e., 3 symbols on the first reel ×3 symbols on the second reel ×3 symbols on the third reel ×3 symbols on the fourth reel ×3 symbols on the fifth reel). It should be appreciated that modifying the number of generated symbols by either modifying the number of reels or modifying the number of symbols generated in active symbol display positions by one or more of the reels modifies the number of ways to win.

In another embodiment, the gaming machine enables a player to wager on and thus activate symbol display positions. In one such embodiment, the symbol display positions are on the reels. In this embodiment, if based on the player's wager, a reel is activated, then each of the symbol display positions of that reel will be activated and each of the active symbol display positions will be part of one or more of the ways to win. In one embodiment, if based on the player's wager, a reel is not activated, then a designated number of default symbol display positions, such as a single symbol display position of the middle row of the reel, will be activated and the default symbol display position(s) will be part of one or more of the ways to win. This type of gaming machine enables a player to wager on one, more than one or all of the reels and the processor of the gaming machine uses the number of wagered on reels to determine the active symbol display positions and the number of possible ways to win. In alternative embodiments, (1) no symbols are displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position is activated on each of the remaining four reels. In this example, as described above, the gaming machine provides the player three ways to win (i.e., 3 symbols on the first reel ×1 symbol on the second reel ×1 symbol on the third reel ×1 symbol on the fourth reel ×1 symbol on the fifth reel). In another example, a player's wager of nine credits may activate each of the three symbol display positions on a first reel, each of the three symbol display positions on a second reel and each of the three symbol display positions on a third reel wherein one default symbol display position is activated on each of the remaining two reels. In this example, as described above, the gaming machine provides the player twenty-seven ways to win (i.e., 3 symbols on the first reel ×3 symbols on the second reel ×3 symbols on the third reel.times.1 symbol on the fourth reel ×1 symbol on the fifth reel).

In one embodiment, to determine any award(s) to provide to the player based on the generated symbols, the gaming machine individually determines if a symbol generated in an active symbol display position on a first reel forms part of a winning symbol combination with or is otherwise suitably related to a symbol generated in an active symbol display position on a second reel. In this embodiment, the gaming machine classifies each pair of symbols, which form part of a winning symbol combination (i.e., each pair of related symbols) as a string of related symbols. For example, if active symbol display positions include a first cherry symbol generated in the top row of a first reel and a second cherry symbol generated in the bottom row of a second reel, the gaming machine classifies the two cherry symbols as a string of related symbols because the two cherry symbols form part of a winning symbol combination.

After determining if any strings of related symbols are formed between the symbols on the first reel and the symbols on the second reel, the gaming machine determines if any of the symbols from the next adjacent reel should be added to any of the formed strings of related symbols. In this embodiment, for a first of the classified strings of related symbols, the gaming machine determines if any of the symbols generated by the next adjacent reel form part of a winning symbol combination or are otherwise related to the symbols of the first string of related symbols. If the gaming machine determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming machine adds the related cherry symbol generated on the third reel to the previously classified string of cherry symbols.

On the other hand, if the gaming machine determines that no symbols generated on the next adjacent reel are related to the symbols of the first string of related symbols, the gaming machine marks or flags such string of related symbols as complete. For example, if the first string of related symbols is the string of related cherry symbols and none of the symbols of the third reel are related to the cherry symbols of the previously classified string of cherry symbols, the gaming machine marks or flags the string of two cherry symbols as complete.

After either adding a related symbol to the first string of related symbols or marking the first string of related symbols as complete, the gaming machine proceeds as described above for each of the remaining classified strings of related symbols which were previously classified or formed from related symbols on the first and second reels.

After analyzing each of the remaining strings of related symbols, the gaming machine determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming machine marks each of the remaining pending strings of related symbols as complete.

When each of the strings of related symbols is marked complete, the gaming machine compares each of the strings of related symbols to an appropriate paytable and provides the player any award associated with each of the completed strings of symbols. It should be appreciated that the player is provided one award, if any, for each string of related symbols generated in active symbol display positions (i.e., as opposed to a quantity of awards being based on how many paylines that would have passed through each of the strings of related symbols in active symbol display positions).

In one embodiment, in addition to winning credits or other awards in a base or primary game, the gaming machine may also give players the opportunity to win credits in a bonus or secondary game or in a bonus or secondary round. In one embodiment, the disclosed enhanced symbol implementation is employed in a bonus or secondary game. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, a bonus triggering event or qualifying condition may be a selected outcome in the primary game or a particular arrangement of one or more indicia on a display device in the primary game, such as the number seven appearing on three adjacent reels along a payline (e.g., the payline 52) in the primary slot game embodiment seen in FIG. 1. In other embodiments, the bonus triggering event or qualifying condition occurs based on exceeding a certain amount of game play (such as number of games, number of credits, amount of time), or reaching a specified number of points earned during game play.

In another embodiment, the gaming machine the processor 12 or central controller 56 randomly provides the player one or more plays of one or more secondary games. In one such embodiment, the gaming machine does not provide any apparent reason to the player for qualifying to play a secondary or bonus game. In this embodiment, qualifying for a bonus game is not triggered by an event in or based specifically on any of the plays of any primary game. That is, the gaming machine may simply qualify a player to play a secondary game without any explanation or alternatively with simple explanations. In another embodiment, the gaming machine (or central server) qualifies a player for a secondary game at least partially based on a game triggered or symbol triggered event, such as at least partially based on the play of a primary game.

In one embodiment, the gaming machine includes a program, which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game-triggering event must occur and the side-wager (or designated primary game wager amount) must have been placed to trigger the secondary game.

Figure 2B:
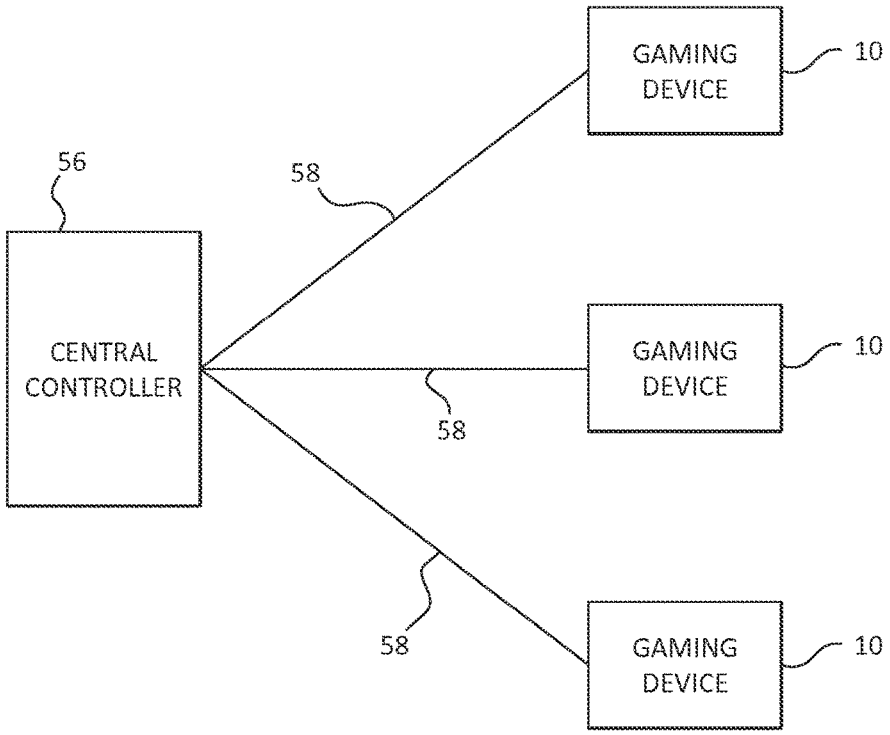
FIG. 2B is a block diagram illustrating gaming machines in communication with a central controller, in which aspects of the present invention may be realized.

In one embodiment, as illustrated in FIG. 2B, one or more of the gaming machines 10 are in communication with each other and/or at least one central controller 56 through a data network or remote communication link 58. In this embodiment, the central server, central controller or remote host is any suitable server or computing device, which includes at least one processor and at least one memory or storage device. In different such embodiments, the central server is a progressive controller or a processor of one of the gaming machines in the gaming system. In these embodiments, the processor of each gaming machine is designed to transmit and receive events, messages, commands, or any other suitable data or signal between the individual gaming machine and the central server. The gaming machine processor is operable to execute such communicated events, messages, or commands in conjunction with the operation of the gaming machine. Moreover, the processor of the central server is designed to transmit and receive events, messages, commands, or any other suitable data or signal between the central server and each of the individual gaming machines. The central server processor is operable to execute such communicated events, messages, or commands in conjunction with the operation of the central server. It should be appreciated that one, more or each of the functions of the central controller, central server or remote host as disclosed herein may be performed by one or more gaming machine processors. It should be further appreciated that one, more or each of the functions of one or more gaming machine processors as disclosed herein may be performed by the central controller, central server or remote host.

In one embodiment, the game outcome provided to the player is determined by a central server or controller and provided to the player at the gaming machine. In this embodiment, each of a plurality of such gaming machines communicates with the central server or controller. Upon a player initiating game play at one of the gaming machines, the initiated gaming machine communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller stores and utilizes program code or other data similar to the processor and memory device of the gaming machine.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming machine. The gaming machine receives the generated or selected game outcome and provides the game outcome to the player. In an alternative embodiment, how the generated or selected game outcome is to be presented or displayed to the player, such as a reel symbol combination of a slot machine, is also determined by the central server or controller and communicated to the initiated gaming machine to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, one or more of the gaming machines are in communication with a central server or controller for monitoring purposes only. That is, each individual gaming machine randomly generates the game outcomes to be provided to the player and the central server or controller monitors the activities and events occurring on the plurality of gaming machines.

In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, a plurality of the gaming machines connects together through a data network. In one embodiment, the data network is a local area network (LAN), in which one or more of the gaming machines are substantially proximate to each other and an on-site central server or controller as in, for example, a gaming establishment or a portion of a gaming establishment. In another embodiment, the data network is a wide area network (WAN) in which one or more of the gaming machines are in communication with at least one off-site central server or controller. In this embodiment, the plurality of gaming machines may be located in a different part of the gaming establishment or within a different gaming establishment than the off-site central server or controller. Thus, the WAN may include an off-site central server or controller and an off-site gaming machine located within gaming establishments in the same geographic area, such as a city or state. The WAN gaming system may be substantially identical to the LAN gaming system described above, although the number of gaming machines in each system may vary relative to one another.

In another embodiment, the data network is an Internet or intranet. In this embodiment, the operation of the gaming machine can be viewed at the gaming machine with at least one Internet browser. In this embodiment, operation of the gaming machine and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an Internet game page from any location where an Internet connection and computer or other Internet facilitator is available. The expansion in the number of computers and number and speed of Internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, a plurality of gaming machines at one or more gaming sites are networked to the central server in a progressive configuration, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming machines distributed throughout a number of properties at different geographical locations including, for example, different locations within a city or different cities within a state.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

Program code embodied on a computer readable medium may be transmitted using any appropriate medium, including but not limited to wireless, wired, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the internet using an internet Service Provider).

Aspects of the present invention have been described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that may direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the above figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block might occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

What is claimed is:

1. A gaming system comprising:

a housing;

at least one display device supported by the housing;

at least one input device supported by the housing;

at least one processor; and at least one memory device which stores a plurality of instructions, which when executed by the at least one processor, cause the at least one processor to operate with the at least one display device and the at least one input device to:

(a) at least partially display a play of a game, the game including:

(i) rotating a plurality of reels having a plurality of symbols, the plurality of reels being part of a first reel set and a second reel set positioned over the first reel set, the plurality of reels of each of the first and second reel sets arranged adjacent each other, the plurality of symbols passing a payline during the rotation of each reel, the plurality of symbols including a plurality of special symbols, and each reel including a plurality of symbol positions associated therewith;

(ii) stopping the rotation of each reel to display one of the plurality of symbols of the reel relative to the payline; and (iii) awarding an award, in response to an identification of a predetermined winning combination of symbols being displayed on the payline;

(b) when a triggering event occurs in association with the play of the game, the triggering event including a first special symbol of the plurality of special symbols stopping on the payline at a first symbol position on a first reel of the first reel set:

(i) superimpose the first special symbol at a symbol position on a second reel of the second reel set corresponding to the first symbol position on the first reel;

(ii) continue to rotate the second reel during the superimposition of the first special symbol thereover;

(iii) resolve rotation of the second reel; and (iv) when as a result of resolving the rotation of the second reel, a second special symbol in the symbol position behind the superimposed first special symbol on the second reel is a higher value special symbol:

(1) change the superimposed first special symbol on the second reel to the higher value special symbol, and (2) change the first special symbol displayed at the first symbol position on the first reel to the higher value special symbol.

2. The gaming system of claim 1, wherein:

the first reel comprises a mechanical reel coupled to the at least one processor, and the second reel is displayed on the at least one display device.

3. The gaming system of claim 2, wherein the plurality of instructions, when executed by the at least one processor further cause the at least one processor to operate with the at least one display device and the at least one input device to:

in response to the triggering event occurring in association with the play of the game, (i) superimpose the first special symbol at a symbol position on a third reel of a third reel set positioned over the second reel set corresponding to the first symbol position on the first reel; and (ii) continue to rotate the third reel during the superimposition of the first special symbol thereover.

4. The gaming system of claim 3, wherein the plurality of instructions, when executed by the at least one processor further cause the at least one processor to operate with the at least one display device to display the third reel on the at least one display device.

5. The gaming system of claim 4, wherein the plurality of instructions, when executed by the at least one processor further cause the at least one processor to operate with the at least one display device and the at least one input device to:

when as the result of resolving the rotation of the second reel, the second special symbol in the symbol position behind the superimposed first special symbol on the second reel is the higher value special symbol:

change the first special symbol displayed on the third reel to display the higher value special symbol, and continue to rotate the third reel during the display of the higher value special symbol.

6. The gaming system of claim 5, wherein the plurality of instructions, when executed by the at least one processor further cause the at least one processor to operate with the at least one display device and the at least one input device to:

resolve rotation of the third reel, and when as a result of resolving the rotation of the third reel, a third special symbol behind the higher value special symbol on the third reel is an even higher value special symbol:

change the higher value special symbol on the third reel to the even higher value special symbol, change the higher value special symbol on the second reel to the even higher value special symbol, and change the higher value special symbol displayed at the first symbol position on the first reel to the even higher value special symbol.

7. The gaming system of claim 6, wherein during the change of the higher value special symbol displayed on the first symbol position on the first reel to the even higher value special symbol, the first reel rotates backwards from the higher value special symbol to the even higher value symbol at a rotational speed that is slower than a rotational speed of the first reel prior to an initial resolution of rotation of the first reel.

8. The gaming system of claim 6, wherein the plurality of instructions, when executed by the at least one processor further cause the at least one processor to operate with the at least one display device and the at least one input device to:

when as a result of resolving the third reel, a fourth special symbol stops at the payline at a symbol position on the third reel corresponding to a second symbol position on the first reel:

change each symbol displayed at the second symbol position on the first reel and at a corresponding symbol position on the second reel to the fourth special symbol.

9. A method of operating a gaming machine comprising:

causing at least one processor to operate with at least one display device and at least one input device to:

(a) display at least partially a play of a game, the game including:

(i) rotating a plurality of reels having a plurality of symbols, the plurality of reels being part of a first reel set and a second reel set positioned over the first reel set, the plurality of reels of each of the first and second reel sets arranged adjacent each other, the plurality of symbols passing a payline during the rotation of each reel, the plurality of symbols including a plurality of special symbols, and each reel including a plurality of symbol positions associated therewith;

(ii) stopping the rotation of each reel to display one of the plurality of symbols of the reel relative to the payline; and (iii) awarding an award, in response to an identification of a predetermined winning combination of symbols being displayed on the payline;

(b) when a triggering event occurs in association with the play of the game, the triggering event including a first special symbol of the plurality of special symbols stopping on the payline at a first symbol position on a first reel of the first reel set:

(i) superimpose the first special symbol at a symbol position on a second reel of the second reel set corresponding to the first symbol position on the first reel;

(ii) continue to rotate the second reel during the superimposition of the first special symbol thereover;

(iii) resolve rotation of the second reel; and (iv) when as a result of resolving the rotation of the second reel, a second special symbol in the symbol position behind the superimposed first special symbol on the second reel is a higher value special symbol:

(1) change the superimposed first special symbol on the second reel to the higher value special symbol, and (2) change the first special symbol displayed at the first symbol position on the first reel to the higher value special symbol.

10. The method of claim 1, wherein:

the first reel is a mechanical reel, and the second reel is displayed on the at least one display device.

11. The method of claim 10, further comprising causing the at least one processor to operate with the at least one display device and the at least one input device to:

in response to the triggering event occurring in association with the play of the game, (i) superimpose the first special symbol at a symbol position on a third reel of a third reel set positioned over the second reel set corresponding to the first symbol position on the first reel; and (ii) continue to rotate the third reel during the superimposition of the first special symbol thereover.

12. The method of claim 11, further comprising causing the at least one processor to operate with the at least one display device to display the third reel on the display screen.

13. The method of claim 12, further comprising causing the at least one processor to operate with the at least one display device and the at least one input device to:

when as the result of resolving the rotation of the second reel, the second special symbol in the symbol position behind the superimposed first special symbol on the second reel is the higher value special symbol:

change the first special symbol displayed on the third reel to display the higher value special symbol, and continue to rotate the third reel during the display of the higher value special symbol.

14. The method of claim 13, further comprising causing the at least one processor to operate with the at least one display device and the at least one input device to:

resolve rotation of the third reel, and when as a result of resolving the rotation of the third reel, a third special symbol behind the higher value special symbol on the third reel is an even higher value special symbol:

change the higher value special symbol on the third reel to the even higher value special symbol, change the higher value special symbol on the second reel to the even higher value special symbol, and change the higher value special symbol displayed at the first symbol position on the first reel to the even higher value special symbol.

15. The method of claim 14, wherein during the change of the higher value special symbol displayed on the first symbol position on the first reel to the even higher value special symbol, the first reel rotates backwards from the higher value special symbol to the even higher value symbol at a rotational speed that is slower than a rotational speed of the first reel prior to an initial resolution of rotation of the first reel.

16. The method of claim 14, further comprising causing the at least one processor to operate with the at least one display device and the at least one input device to:

when as a result of resolving the third reel, a fourth special symbol stops at the payline at a symbol position on the third reel corresponding to a second symbol position on the first reel:

change each symbol displayed at the second symbol position on the first reel and at a corresponding symbol position on the second reel to the fourth special symbol.

17. A non-transitory computer readable medium which stores a plurality of instructions which, when executed by at least one processor, cause the at least one processor to operate with at least one display device and at least one input device to:

(a) at least partially display a play of a game, the game including:

(i) rotating a plurality of reels having a plurality of symbols, the plurality of reels being part of a first reel set and a second reel set positioned over the first reel set, the plurality of reels of each of the first and second reel sets arranged adjacent each other, the plurality of symbols passing a payline during the rotation of each reel, the plurality of symbols including a plurality of special symbols, and each reel including a plurality of symbol positions associated therewith;

(ii) stopping the rotation of each reel to display one of the plurality of symbols of the reel relative to the payline; and (iii) awarding an award, in response to an identification of a predetermined winning combination of symbols being display on the payline;

(b) when a triggering event occurs in association with the play of the game, the triggering event including a first special symbol of the plurality of special symbols stopping on the payline at a first symbol position on a first reel of the first reel set:

(i) superimpose the first special symbol at a symbol position on a second reel of the second reel set corresponding to the first symbol position on the first reel;

(ii) continue to rotate the second reel during the superimposition of the first special symbol thereover;

(iii) resolve rotation of the second reel; and (iv) when as a result of resolving the rotation of the second reel, a second special symbol in the symbol position behind the superimposed first special symbol on the second reel is a higher value special symbol:

(1) change the superimposed first special symbol on the second reel to the higher value special symbol, and (2) change the first special symbol displayed at the first symbol position on the first reel to the higher value special symbol.

18. The non-transitory computer readable medium of claim 17, wherein the plurality of instructions, when executed by the at least one processor further cause the at least one processor to operate with a mechanical reel, the first reel being the mechanical reel, and to operate with the at least one display device to display the second reel.

19. The non-transitory computer readable medium of claim 18, wherein the plurality of instructions, when executed by the at least one processor further cause the at least one processor to operate with the at least one display device and the at least one input device to:

in response to the triggering event occurring in association with the play of the game, (i) superimpose the first special symbol at a symbol position on a third reel of a third reel set positioned over the second reel set corresponding to the first symbol position on the first reel; and (ii) continue to rotate the third reel during the superimposition of the first special symbol thereover.

20. The non-transitory computer readable medium of claim 19, wherein the plurality of instructions, when executed by the at least one processor further cause the at least one processor to operate with the at least one display device to display the third reel on the display screen.

21. The non-transitory computer readable medium of claim 20, wherein the plurality of instructions, when executed by the at least one processor further cause the at least one processor to operate with the at least one display device and the at least one input device to:

when as the result of resolving the rotation of the second reel, the second special symbol in the symbol position behind the superimposed first special symbol on the second reel is the higher value special symbol:

change the first special symbol displayed on the third reel to display the higher value special symbol, and continue to rotate the third reel during the display of the higher value special symbol.

22. The non-transitory computer readable medium of claim 21, wherein the plurality of instructions, when executed by the at least one processor further cause the at least one processor to operate with the at least one display device and the at least one input device to:

resolve rotation of the third reel, and when as a result of resolving the rotation of the third reel, a third special symbol behind the higher value special symbol on the third reel is an even higher value special symbol:

change the higher value special symbol on the third reel to the even higher value special symbol, change the higher value special symbol on the second reel to the even higher value special symbol, and change the higher value special symbol displayed at the first symbol position on the first reel to the even higher value special symbol.

23. The non-transitory computer readable medium of claim 22, wherein the plurality of instructions, when executed by the at least one processor further cause the at least one processor to operate with the at least one display device and the at least one input device to:

during the change of the higher value special symbol displayed on the first symbol position on the first reel to the even higher value special symbol, the first reel rotates backwards from the higher value special symbol to the even higher value symbol at a rotational speed that is slower than a rotational speed of the first reel prior to an initial resolution of rotation of the first reel.

24. The non-transitory computer readable medium of claim 18, wherein the plurality of instructions, when executed by the at least one processor further cause the at least one processor to operate with the at least one display device and the at least one input device to:

when as a result of resolving the third reel, a fourth special symbol stops at the payline at a symbol position on the third reel corresponding to a second symbol position on the first reel:

change each symbol displayed at the second symbol position on the first reel and at a corresponding symbol position on the second reel to the fourth special symbol.

* * * * *